US005755212A

United States Patent [19]

Ajima

[11] Patent Number: 5,755,212

[45] Date of Patent: May 26, 1998

[54] AIR-FUEL RATIO CONTROL SYSTEM FOR INTERNAL COMBUSTION ENGINE

[75] Inventor: Takumi Ajima, Zama, Japan

[73] Assignee: Matsushita Electric Industrial Co., Ltd., Osaka, Japan

[21] Appl. No.: 723,143

[22] Filed: Sep. 30, 1996

[30] Foreign Application Priority Data

Sep. 29, 1995 [JP] Japan ..... 7-252130

[51] Int. Cl.[6] ..... F02D 41/00

[52] U.S. Cl. ..... 123/674

[58] Field of Search ..... 123/674, 424; 60/274; 364/424.1

[56] References Cited

U.S. PATENT DOCUMENTS

| | | | |
|---|---|---|---|
| 5,247,445 | 9/1993 | Miyano et al. | 123/674 |
| 5,419,302 | 5/1995 | Abe | 123/674 |
| 5,434,779 | 7/1995 | Vukovich et al. | 364/424.1 |
| 5,464,000 | 11/1995 | Pursifull et al. | 123/674 |
| 5,465,697 | 11/1995 | Hamburg et al. | 123/424 |
| 5,465,703 | 11/1995 | Abe | 123/674 |
| 5,501,206 | 3/1996 | Takebayashi | 123/674 |
| 5,511,526 | 4/1996 | Hamburg et al. | 123/424 |
| 5,598,702 | 2/1997 | Uchikawa | 60/274 |
| 5,617,836 | 4/1997 | Cullen et al. | 123/674 |
| 5,632,261 | 5/1997 | Maki et al. | 123/674 |

FOREIGN PATENT DOCUMENTS

| | | | |
|---|---|---|---|
| 3-235725 | 10/1991 | Japan | 123/674 |
| 6-17680 | 1/1994 | Japan | 123/674 |
| 8-74636 | 3/1996 | Japan | 123/674 |

*Primary Examiner*—Raymond A. Nelli

*Attorney, Agent, or Firm*—Lowe, Price, Leblanc & Becker

[57] ABSTRACT

An air-fuel ratio control system with a high accuracy for an internal combustion engine which is capable of particularly improving the transient response characteristic irrespective of the occurrence of an air-fuel ratio sensor delay and a fuel attachment. An in-cylinder air-fuel ratio is calculated on the basis of engine data obtained in advance so that an neural network (NN) receiving a fuel injection quantity involving the past value and air quantity estimating information such as an intake pressure and outputting a calculated in-cylinder air-fuel ratio undergoes learning. In the actual control, a difference between the in-cylinder air-fuel ratio estimated in the NN and the target air-fuel ratio is taken on the basis of information such as a fuel injection quantity varying with the time and the output of the NN is partially differentiated with respect to the fuel injection quantity, so that the difference therebetween is divided by the resultant partial differential coefficient to obtain a fuel correction amount whereby the in-cylinder air-fuel ratio coincides with the target air-fuel ratio. The fuel injection quantity is corrected with this correction amount to calculate a final fuel injection quantity. That is, the in-cylinder air-fuel ratio is controlled to approach the target air-fuel ratio so that the exhaust gas air-fuel ratio equals the target air-fuel ratio.

17 Claims, 20 Drawing Sheets

AIR-FUEL RATIO CONTROL SYSTEM FOR INTERNAL COMBUSTION ENGINE

BACKGROUND OF THE INVENTION

1. [Field of the Invention]

The present invention relates to an air-fuel ratio control system which controls an air-fuel ratio in an internal combustion engine serving as a motive power for motor vehicles or the like.

2. [Description of the Related Art]

Recently, the exhaust gas from motor vehicles has come under a strict regulation for the purpose of global environmental conservation. Generally, motor vehicles with a gasoline engine employ a catalytic converter rhodium for the exhaust gas purification, while this catalytic converter rhodium greatly varies in exhaust gas purification property with the air-fuel ratio of its engine. The air-fuel ratio signifies a ratio of an air quantity to a combustion fuel quantity, and the air-fuel ratio, when being 14.7, is referred to as the theoretical air-fuel ratio, where the catalytic converter rhodium exhibits the best exhaust gas purification property. If the actual air-fuel ratio deviates from the theoretical air-fuel ratio in both a rich direction of assuming an excessively fuel supplying condition and a lean direction of falling into an excessively air supplying condition, the exhaust gas purification characteristic deteriorates. Thus, a problem as to how to maintain the air-fuel ratio in the theoretical air-fuel ratio condition occurs in terms of the exhaust gas purification.

For the air-fuel ratio control, a common way is that the fuel injection quantity is determined or set so that the air-fuel ratio coincides with the theoretical air-fuel ratio, for that difficulty is encountered to control the air quantity. For this reason, for the determination of the fuel injection quantity corresponding to that air quantity, estimation of the quantity of air flowing into a cylinder is made on the basis of an atmospheric pressure within an intake manifold, an opening degree of a throttle valve, an atmospheric temperature, a cooling water temperature, an engine speed, an exhaust gas rotary flow rate (EGR), and so on. Although the air quantity exactly signifies the amount of oxygen, since air is, in fact, fed into a cylinder to supply oxygen thereinto, for the description the quantity of oxygen supplied is treated herein as the amount of air taken in.

More specifically, information (which will be referred hereinafter to as air quantity estimating information) for estimating the air quantity flowing into the aforesaid cylinder is first measured through an experiment, and then the estimation of the air quantity into the cylinder is made on the air quantity estimating information in order to calculate the fuel injection quantity as a function of this air quantity so that the air-fuel ratio assumes 14.7, with the relationship therebetween being recorded beforehand in the form of a table or an empirical formula. The actual internal combustion engine is designed to directly obtain the fuel injection amount on the basis of the found air quantity estimating information through the retrieval of a table prerecorded or according to an empirical formula. The fuel injection quantity thus given is referred to as a basic fuel injection quantity, and the actual control of the fuel injection quantity is on the basis of this basic fuel injection quantity. This controlling way is called a feedforward (which will hereinafter be abbreviated to FF).

For the actual control, the engine is generally equipped with an $O_2$ sensor, an LAF sensor or the like serving as an air-fuel ratio sensor so that the feedback (which will hereinafter be abbreviated as FB) to the fuel injection quantity is made through the use of the output equivalent to the air-fuel ratio measured with the air-fuel ratio sensor, whereas the difference between the actual air-fuel ratio measure with the air-fuel ratio sensor and the theoretical air-fuel ratio being the ideal air-fuel ratio is obtained to output the fuel injection quantity corresponding to the difference therebetween to add it to the basic fuel injection quantity.

However, the above-mentioned air-fuel ratio control system is a time-varying nonlinear system in which a time delay takes place in the transfer function of the engine between the output of the fuel injection quantity and the measurement of the air-fuel ratio, and hence there is a problem which arises with the control made with a fixed FB coefficient in that, for example, the control error goes large particularly in a transient condition such as a variation of the opening degree of the throttle valve. A major factor to the time delay is that, after the injection and explosion of the fuel, it takes time until the exhaust gas comes to the air-fuel ratio sensor and the air-fuel ratio sensor is responsive thereto so that its output varies. This time delay will be referred hereinafter to as air-fuel ratio sensor delay.

Secondly, a description will be taken about an fuel adhesion or attachment phenomenon. The fuel injected through an injector shows a complicated mechanism. That is, the injected fuel all does not get into a gasified condition but partially remains as a liquid within the intake manifold to adhere to its inner wall not to flow into the cylinder, thereafter the remaining liquid is gasified at a time constant and enters the cylinder in the following cycles or periods. In addition, the fuel attachment rate, the time constant of the evaporation and others do not assume a fixed value but depends upon the operating states of the engine. This fuel attachment phenomenon also causes the transient response characteristic to deteriorate and, thus, creates an issue.

One solution to these problems is to utilize the state FB in the modern control theory. This is not an FB method depending on only the air-fuel ratio sensor involving a great delay, but being a method of FB to the fuel injection quantity upon reflection of the internal states of the engine such as the in-cylinder air-fuel ratio and the fuel attachment amount, which can realize the control with a relatively high transient response characteristic and with less delay from the fuel injection. However, difficulty is experienced to actually measure the engine internal states such as the in-cylinder air-fuel ratio and the fuel attachment quantity, and hence the internal states are necessary to indirectly measure through an observer. In this instance, for estimating the internal states by the indirect measurement from the external through the observer, a correct model of a plant is necessary, while the estimation of the internal states becomes difficult in the case of an engine being a controlled object in which the internal coefficients varies with time. For this reason, there has been known a method of obtaining the internal coefficients through identification as well as the adaptive control or the like. However, in cases where the internal coefficients abruptly vary, its transient response characteristic deteriorates due to the delay of the internal coefficient identification. Thus, as disclosed in the Japanese Unexamined Patent Publication No. 6-17680, the internal coefficients are roughly found from a table or an empirical formula made up on the basis of data measured in advance and, thereafter, the errors of the internal states are corrected through the adaptive control. The aforesaid identification operations each requires approximately five multiplications implemented continuously and defies the completion within one control cycle, thus resulting in a convergence calculation performed over a plurality of control cycles so that the number of times of the multiplications continuously done approaches the infinity. In this case, a problem occurs in the calculation accuracy, and the use of the floating-point arithmetic is common. This is because it is relatively difficult to limit the range of a value each parameter takes and further difficult to estimate the influence the arithmetic accuracy exerts on the results. Whereupon, a CPU (Central Processing Unit) with a high performance is needed which can perform the floating-point arithmetic in the real time.

As obvious from the above description, in the control of the time-varying nonlinear system such as the air-fuel ratio control for an internal combustion engine, the internal coefficients of the plant in various conditions are necessary to previously store and use from the viewpoint of improving the transient response characteristic, moreover a method of completing the calculation within one control cycle concurrently with reducing the number of times of continuous multiplications and shortening the arithmetic word length is effective in using a low-cost CPU. For these reasons, as a general way, employed is a table previously storing the internal coefficients of the plant or the like or an empirical formula for obtaining the internal coefficients thereof. This way will be referred hereinafter to as a table method.

In this table method, data is previously found from experiment and stored in a memory in the form of a table. However, although there is no problem in the case of a two-dimensional table, if forming a three or more dimensional table, the memory capacity is required to increase for the storage of the data taken. For eliminating this problem, through the analysis of the information on the plant and the data found, a portion of the table is left but the table as many as possible is brought close to the form of empirical formula. A problem of this table method is that difficulty is encountered to make up a table in a transient condition. In addition, the table method features the interpolation made by using data at typical points and, hence, high accuracy is necessary for the determination of the typical points. For this reason, a plurality of data are collected at the typical point and averaged. Although, in the steady-state, the collection of a plurality of data on the same condition is easy, in the case of the transient state, obtaining a plurality of data on the same condition is extremely difficult. Even if possible, it takes a considerable long time to attain data necessary for ensuring a given accuracy. Moreover, since it is difficult to change the table values or the empirical formula during the operation, the initial values result in being used for an extremely long period of time. In this respect, the table method can not cope with the passage of time. Besides, making up a table for each object is impracticable, whereupon the table method can not overcome the variation among the objects.

As seen from the above description, the table method has the following disadvantages. When being put in order, (1) the information or knowledge about the plant is necessary;

(2) it takes time to collect data and to make up the empirical formula;

(3) errors arise at the conversion into the empirical formula;

(4) it is difficult to store the data in a transient condition;

(5) there is a possibility that the capacity of the memory used increases; and (6) it is impossible to overcome the passage of time and the variations among the objects.

As a method of supplementing these disadvantages of the table method, the use of a neural network (which will be referred hereinafter to as NN) has been known as disclosed by Japanese Unexamined Patent Publication No. 3-235723 or as stated in Japanese Patent Application No. 6-216169 (this does not constitute a prior art because of being not yet published). The NN learning data per se is a set of state discrete data, while it is for providing a smooth hyper-curved surface approximating these through the learning. In the case that production of a correct model is difficult while the input and output relationship is known, it is generally said that the feature of the NN is to allow making up a function representative of the input and output relationship through the learning. In this sense, the NN is misunderstood to be a universal computer, but in fact a desirable accuracy is unobtainable irrespective of the learning if there is no correlation between the input and the output. Thus, in the case of stating equipment using the NN, an important thing is that the learning is made with the input and output which are in a high correlation. With a low correlation between the input and the output, its realization becomes difficult. The degree of the correlation between the input and the output is finally determinable according to the learning error in the learning results, whereas actually it greatly depends upon the modeling of the object. In the NN-applying control field, it is said that, although the NN can be treated as a block box whether or not the modeling is possible, in fact the modeling is essential. This is for modeling as much as possible to make clear the relationship between the input and the output and hence to decide a necessary input.

One example of the NN-based control applied to the engine air-fuel ratio control has been disclosed in Japanese Unexamined Patent Publication No. 3-235723. Supposing this application example from the stated contents, various sensors sense the cooling temperature, the engine speed, the air quantity flowing into the cylinder and other quantities so that the sensed data are used as the input information to the NN and the output produced from the NN is handled as the fuel injection quantity. The NN-based control example disclosed in this publication seems to be effective in cases where the engine does not show the above-mentioned air-fuel ratio sensor delay and fuel attachment phenomenon or in cases where the operation stays within a range in which the throttle valve opening degree does not greatly vary. On the other hand, in the case that the throttle valve opening degree greatly varies and the air-fuel ratio sensor delay and the fuel attachment phenomenon can not be disregarded, if only using such an input, the learning accuracy can considerably deteriorate and the control characteristic can fall exceedingly.

On the other hand, in the aforesaid Japanese Patent Application No. 6-216169, the input information is determined through the use of a model taking the fuel attachment into consideration so that the input and output correlation goes high. In other words, in addition to the data at that time, the past data is also added as the input information, deductively obtaining the necessary previous data. The high correlation in this method has been proven indirectly through the learning errors and the control results of the real engine. However, it can be presumed from the following reason that this method has been developed in view of an engine demonstrating a little air-fuel ratio sensor delay. That is, when in this method the control period (which will be referred hereinafter as to TDC) corresponds to the ignition timing, the time taken from the injection and explosion of the fuel to the reaction of the air-fuel ratio sensor to the resulting exhaust gas exceeds 10 times the control period. If the air-fuel ratio sensor is set close to the cylinder in order to shorten the time taken until the air-fuel ratio sensor responds to the exhaust gas, the delay is extremely reducible. However, in this case, the air-fuel ratio sensor is exposed to an extremely high temperature so that its service life decreases, besides, in the case of a multiple cylinder engine, an air-fuel ratio sensor is needed at every cylinder, with the raised cost.

Analyzing the statement about this method, the fuel attachment model is a first order lag element and, hence, accepts the fuel injection quantities gf(k) and gf(k−1). If omitting the detailed equation calculations but showing the result, when the air-fuel ratio sensor delay is taken as nTDC, the data till gf(k−n) are necessary, and assuming that a first order lag low-pass filter is present in a portion of the air-fuel ratio, there is a need for two air-fuel ratio (A/F) inputs. Accordingly, as the air-fuel ratio sensor delay increases, the number of inputs to the NN increases. Even if the number of inputs increases, a constant number does not create a problem. Nevertheless, the air-fuel ratio sensor delay constitutes a function of the control period or the exhaust gas velocity and does not always assume nTDC. There is a possibility that n varies in accordance with the engine speed. In the case that the learning of the NN is made in an offline fashion, the learning data can be made up taking into consideration the air-fuel ratio sensor delay n (the air-fuel ratio sensor delay normalized with TDC) at every data. On the other hand, if an engine is controlled by actually using the NN, the change of the number of inputs according to the engine speed results in an extremely complicated processing. Further, the increase in the number of inputs lengthens the time required for the learning, and increases the processing quantity even in the actual control system, which will require a CPU with a high performance. Moreover, according to this method the FB coefficient is instantaneously obtainable without the need for identification. However, because of the presence of the air-fuel ratio sensor delay, the FB by the A/F in the state FB delays so that the transient response characteristic deteriorates.

Generally the NN is convenient while being in danger. On the other hand, as described above the table method is engineered such that, for example, the engineer additionally uses an empirical formula taking into consideration the meaning of the physical quantity, and hence its advantage is that the relationship between the input and output is wholly obvious. This signifies that even the maximum value of the fuel injection quantity can surely be specified and, even in the case of the specification change within the speed region, for example, when the fuel injection quantity is increased on the condition that the throttle opening degree is above a given value, the change of the table is readily possible. However, the coupling coefficient of the NN learning result hardly means a physical quantity, and, for example, a logical support has not been given to the stability of the control system based on the NN. Thus, in order to ensure the safety, in addition to the operation test a fail-safe function is essential throughout a possible operating region. Particularly, in the case of equipment affecting the life of the human beings, the presence of the fail-safe function or easy addition of the fail-safe function is important from an industrial point of view. Further, if the aforesaid specification change takes place, the point may be that learning data is made up to eliminate the need for re-starting the learning.

As described above, with the prior methods, the air-fuel ratio control system for an internal combustion engine needs to include a CPU with a high performance which is capable of carrying out a large amount of complicated calculation and operation for a short period of time, and further difficulty is experienced to realize the air-fuel ratio control with a high accuracy which can exhibit stability and an excellent transient response characteristic to ensure the safety at its operation.

SUMMARY OF THE INVENTION

The present invention has been developed with a view to eliminating the above-described problems, and it is therefore an object of the present invention to provide an air-fuel ratio control system for an internal combustion engine which is capable of realizing air-fuel ratio control with a high accuracy, which can exhibit an excellent transient response characteristic to ensure the safety during its operation, at a low cost and at a small number of processing steps without the use of a CPU with a high performance.

For this purpose, in an internal combustion engine, measurement is made to attain time series data including oxygen quantity estimating information for estimating an oxygen quantity flowing into a cylinder, a fuel injection quantity into the cylinder and an air-fuel ratio found by detecting an oxygen quantity of an exhaust gas through an air-fuel ratio sensor, and the obtained time series data are applied to an engine model produced on the basis of a fuel attachment mechanism within an intake manifold and a time delay between the moment a fuel injection takes place and the moment the air-fuel ratio sensor responds to the exhaust gas to detect the oxygen quantity, thus calculating an internal coefficient of the engine model and an air-fuel ratio within the cylinder. Subsequently, a neural network accepts the oxygen quantity estimating information and the fuel injection quantity and learns the calculated in-cylinder air-fuel ratio to learn the relationship among the oxygen quantity estimating information, the fuel injection quantity and the in-cylinder air-fuel ratio. In addition, after the completion of the learning the neural network is responsive to the oxygen quantity estimating information varying with time, a constant or regular value being the current fuel injection quantity and the past fuel injection quantity to calculate an estimated in-cylinder air-fuel ratio on the basis of these inputs and output the calculation result to obtain the difference between the estimated in-cylinder air-fuel ratio from the neural network and a target or command air-fuel ratio preset as a target value and further to obtain a partial derivative (partial differential value) through the partial differentiation of the estimated in-cylinder air-fuel ratio with respect to the fuel injection quantity so that an ideal fuel injection quantity is calculated on the basis of a value obtained by dividing the difference between the estimated in-cylinder air-fuel ratio and the target air-fuel ratio by the partial derivative. The ideal fuel injection quantity allows the estimated in-cylinder air-fuel ratio to coincide with the target air-fuel ratio, with the result that the actual fuel injection quantity into the cylinder is controllable to equal the ideal fuel injection quantity.

With this arrangement, the engine model is produced taking into consideration the fuel attachment mechanism and the air-fuel ratio sensor delay and the engine internal coefficient and the in-cylinder air-fuel ratio are calculated through a reverse or inverse operation on the basis of the engine data measured. The delay between the occurrence of the fuel injection and the detection of the in-cylinder air-fuel ratio corresponds to only a delay 1 TDC due to the fuel attachment but is not affected by the air-fuel ratio sensor delay. For the actual control, a constant value being the present fuel injection quantity of the fuel injection quantities is inputted, where the estimated in-cylinder air-fuel ratio is attained from the output of the neural network. This is generally shifted from the target air-fuel ratio being 14.7. If performing the partial differential of the output of the neural network with respect to the present fuel injection quantity, the relationship between the present fuel injection quantity and the estimated in-cylinder air-fuel ratio is attainable. Thus, the reverse operation of the current fuel injection quantity can be made such that the estimated in-cylinder air-fuel ratio comes to the target air-fuel ratio. The current fuel injection quantity obtained through the reverse operation is set to the actual fuel injection quantity. When the control cycle advances, the last actual fuel injection quantity is used as the latest fuel injection quantity for the calculation. This control system always controls the in-cylinder air-fuel ratio to the target air-fuel ratio, and hence the air-fuel ratio of the exhaust gas detected in delay also coincides with the target air-fuel ratio. Accordingly, the ideal fuel injection quantity can be calculated at every control timing even in a transient condition where the oxygen quantity estimating information varies.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
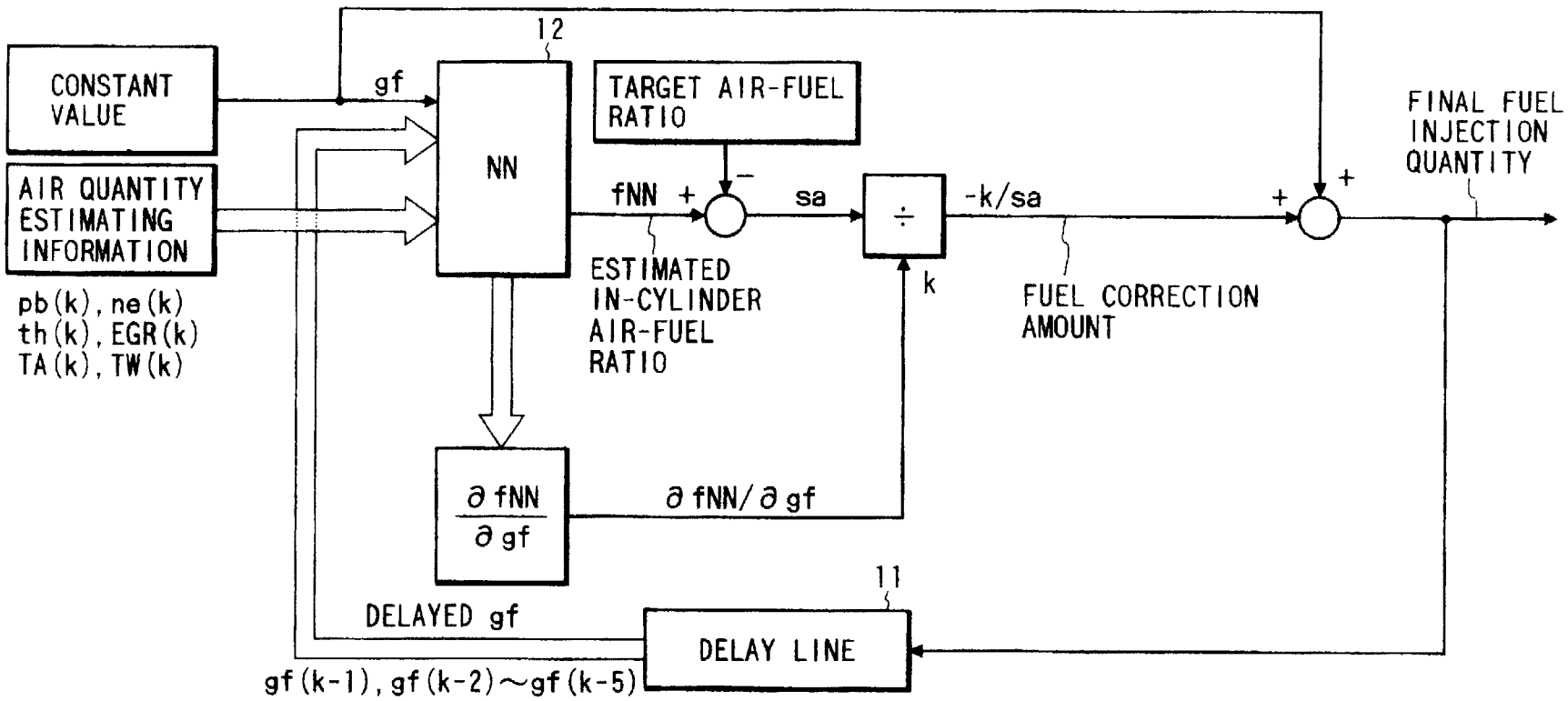
FIG. 1 is a control block diagram showing an air-fuel ratio control system according to an embodiment of the present invention.

Referring to the drawings, a description will be made hereinbelow of an air-fuel ratio control system for an internal combustion engine according to embodiments of the present invention. For the description of this invention, a common gasoline engine is taken as one example of the internal combustion engine.

FIG. 1 is a control block diagram showing an air-fuel ratio control system according to a first embodiment of this invention, where double lines represent vector data (those in the following illustrations represent the same). First of all, a delay line 11 produces the past fuel injection quantities gf(k−1), gf(k−2), . . . gf(k−5) on the basis of the last fuel injection quantity being an amount of fuel actually supplied into an engine and supplies the resultant to a neural network (NN) 12. In addition, as air quantity estimating information for estimating an oxygen quantity flowing into a cylinder (more exactly, oxygen quantity estimating information for estimating the oxygen quantity coming into the cylinder), also inputted are, for example, an intake pressure pb(k) within an intake manifold, a throttle opening degree th(k), a cooling water temperature TW(k), an atmospheric temperature TA(k), an engine speed ne(k) and an exhaust gas rotary flow rate EGR(k). Further, a constant value is inputted as the current fuel injection quantity gf, with the constant value being set to within a commonly possible range. In this instance, the NN 12 outputs an estimated in-cylinder air-fuel ratio fNN in the case that the current fuel injection quantity gf assumes the constant value. Because this does not necessarily coincide with the target air-fuel ratio, the difference sa from the target air-fuel ratio is taken. On the other hand, because of being capable of performing the partial differential (differentiation) of the input and output, the NN 12 obtains a value k by the partial differential of the estimated in-cylinder air-fuel ratio being the output with respect to the present fuel injection quantity gf being the input. Although the variation of the output can also be got by making the input slightly vary, in this case the calculation amount increases, whereupon the equation inside the NN 12 is transformed for simplification. Since this equation transformation is not difficult, the description thereof will be omitted herein.

The result k thus seen is divided by the difference sa so that a fuel correction amount −k/sa is obtained with its sign being inverted. This fuel correction amount −k/sa is added to the constant value being set as the present fuel injection quantity gf, thus creating the final fuel injection quantity. It is readily presumable that the estimated in-cylinder air-fuel ratio fNN coincides with the target air-fuel ratio when this final fuel injection quantity is given as the present fuel injection quantity. If the in-cylinder air-fuel ratio equals the target air-fuel ratio, although involving a delay, the exhaust gas air-fuel ratio (the output of an air-fuel ratio sensor placed in an exhaust pipe) becomes equal to the target air-fuel ratio. In cases where the target air-fuel ratio needs to change in accordance with the operating condition, this is achievable by changing the target air-fuel ratio in the illustration.

As the air quantity estimating information being input to the NN 12, used are six kinds of information including the intake pressure pb within the intake manifold. However, these six kinds of information do not constitute essential requirements, and it is also possible to simplify them or to employ different information. For example, in the case that this control is implemented only when the engine is in a warmed condition, since the cooling water temperature TW is considered to be constant, the cooling water temperature TW become unnecessary. Further, in the case of the L-messer system type engine using an air-flow meter, a hot-wire current meter or the like, the value from the sensor is inputted in place of the intake pressure pb.

Figure 2:
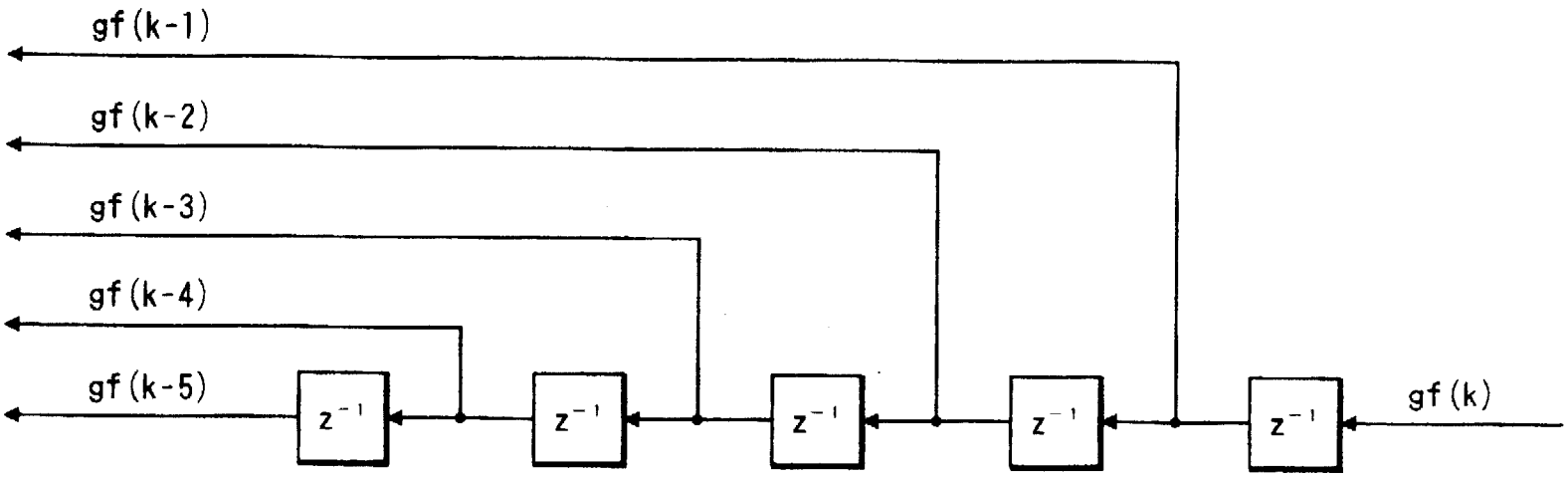
FIG. 2 is an explanatory illustration of a delay line in the FIG. 1 embodiment.

A further description will be made about the delay line in FIG. 1. That is, as shown in FIG. 2 the outputs delayed by 1 TDC (control period=combustion cycle) are taken out. This embodiment obtains and uses the outputs up to gf(k−5) delayed five times, while the number of times of the delay depends upon an engine being a controlled object and an operating condition and limitation is not imposed on the number of times of the delay. A way of determining the number of times of the delay will be described later.

Figure 3:
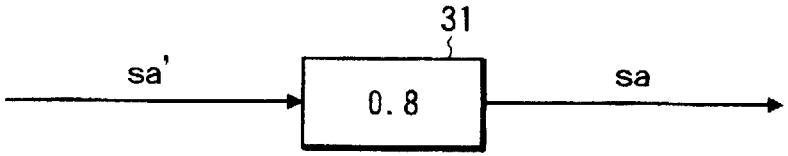
FIG. 3 is an illustration of a structure of a compensator in the FIG. 1 embodiment.

The FIG. 1 controller plays a role of a feedforward (which will hereinafter abbreviated as FF) in determining the fuel injection quantity, whereas a feedback (which will hereinafter be abbreviated as FB) loop exists in its interior. Assuming that the learning error of the NN 12 is zero, a pole is present on a unit circle in a z plane, which can cause instability. However, this problem easily accepts solution in such a way that a compensator containing an appropriate compensation element is incorporated into the interior of the loop. The simplest compensator includes a gain element whose gain is between 0 and 1, the structure of which is shown in FIG. 3. The FIG. 3 compensator, designated at 31, is to be put in the sa portion in FIG. 1, while the sa in FIG. 1 is not applied to the k division element but is inputted into sa' in FIG. 3 so that the sa output in FIG. 3 is inputted into the k division element in FIG. 1. In the FIG. 3 compensator 31, the gain of the gain element is set to 0.8.

Figure 4:
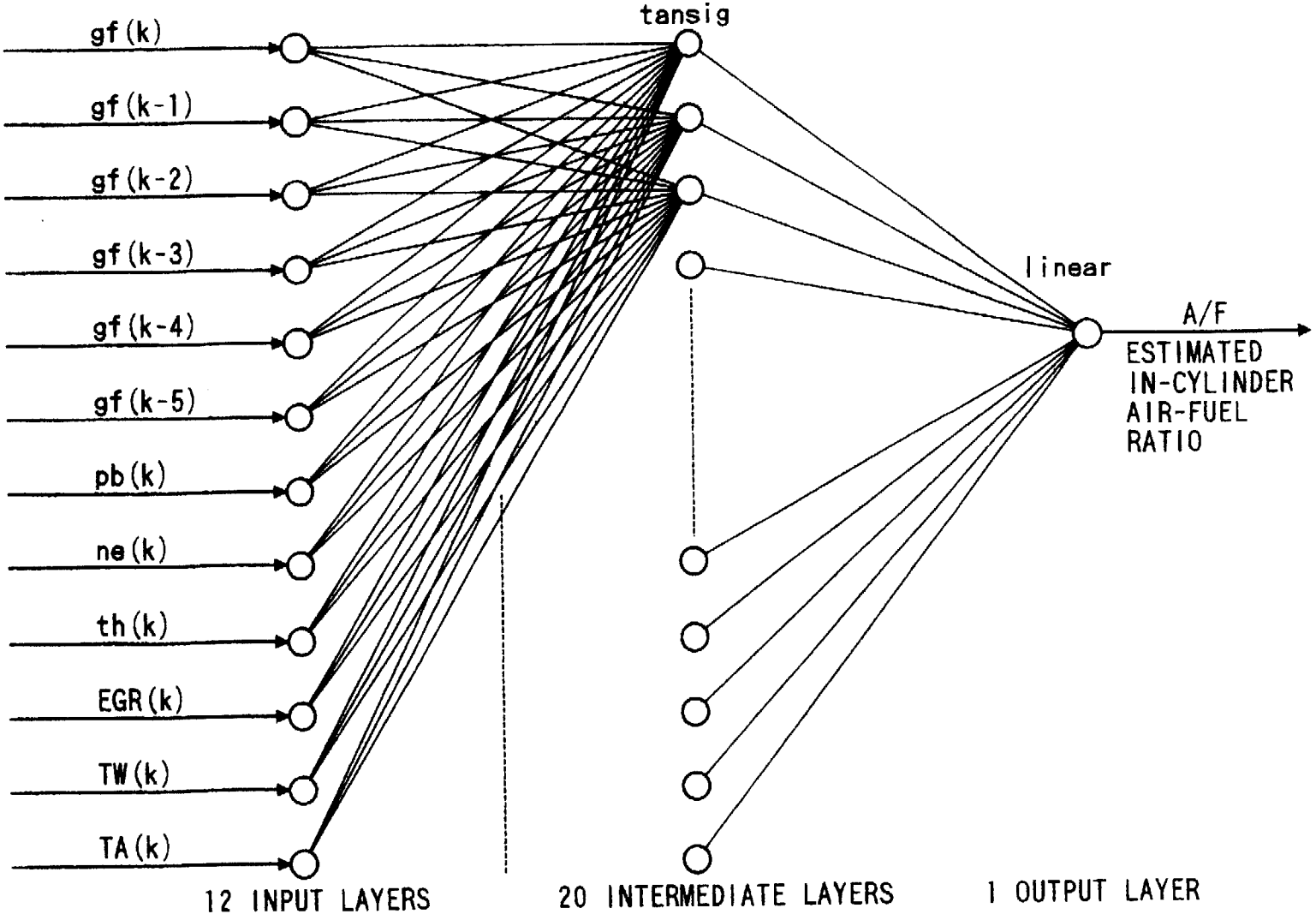
FIG. 4 is an illustration of a structure of a neural network (NN) in the FIG. 1 embodiment.

FIG. 4 is an illustration of a structure of the NN. In FIG. 4, the NN has a three-hierarchy structure, where the number of input layers is 12, the number of intermediate layers is 20 whose threshold function is based on the tangent sigmoid (tansig in FIG. 4), and the number of output layers is one whose threshold function assumes 1 that is the simplest linear function (linear in FIG. 4).

Figure 5:
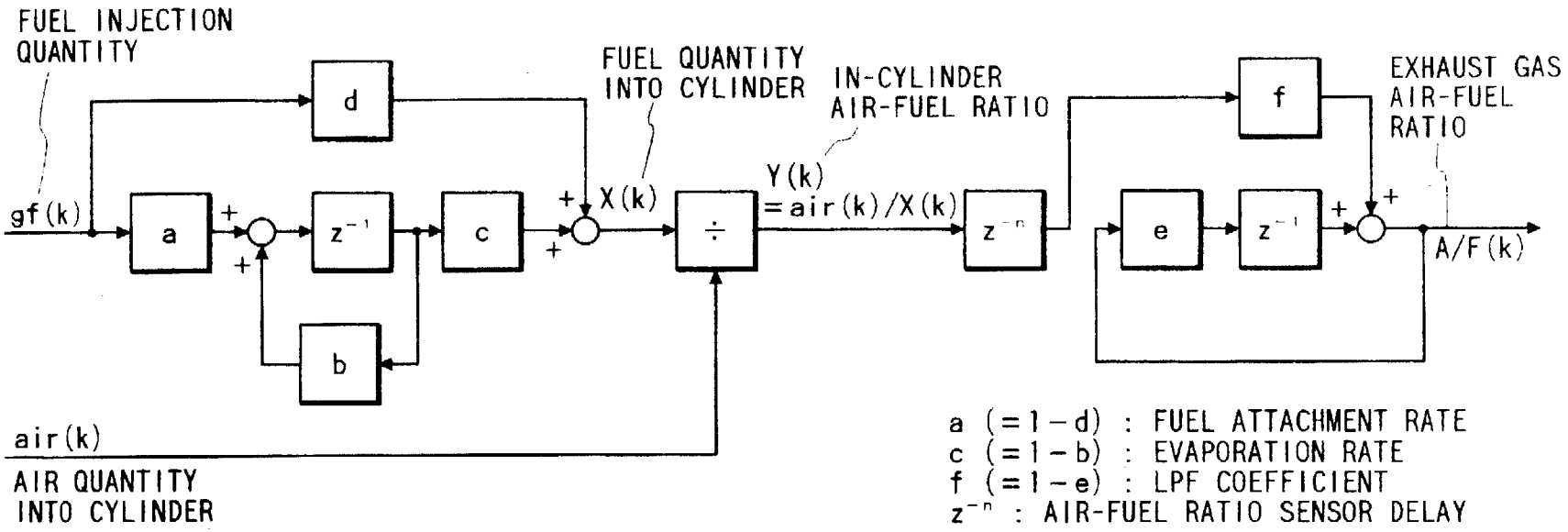
FIG. 5 is an illustration of a structure of an engine model in the FIG. 1 embodiment.

Prior to describing the determination of the kinds of inputs to the NN and the production of the learning data, a description will first be made of a model of an engine being a controlled object. FIG. 5 is an illustration of a structure of the engine model, where the first half section shows a fuel attachment model comprising coefficients a, b, c, and d while the second half section indicates a low-pass filter (which will hereinafter be abbreviated as LPF) composed of coefficients e and f in the air-fuel ratio sensor section. The coefficient a represents the fuel attachment rate, c designates the evaporation rate. Since the fuel attachment and the LPF is stated in the above-mentioned prior art disclosing documents, the description thereof will be omitted for brevity. In FIG. 5, the reciprocal ratio of a fuel quantity X(k) flowing into a cylinder, which is the output of the fuel attachment model, to an air quantity air(k) coming in the cylinder constitutes an in-cylinder air-fuel ratio Y(k). In this fuel attachment model, the delay due to the combustion cycle of the engine or the time between the moment the exhaust gas exits from the cylinder to reach the air-fuel ratio sensor and the moment that sensor responds to the exhaust gas is taken as nTDC and a time delay element $z^{-n}$ is inserted thereinto. This delay will hereinafter be called an air-fuel ratio sensor delay. In this case, since the coefficients a, b, c, d, e, and f are functions of the time k, exactly these coefficients should be stated as a(k), b(k) . . . . nevertheless (k) is omitted for simplicity.

Looking at the parameters in FIG. 5, only the fuel injection quantity gf(k) and the exhaust gas air-fuel ratio A/F(k) accepts the actual measurement, while the other parameters are considerably difficult to measure. For this reason, attempt to reverse-operate the other parameters on the basis of the gf and the A/F is taken. The unknown but necessary parameters are a, c, air, and f, for that the parameters b, d and e are obtainable from a, c and f, respectively. Character f signifies an LPF coefficient. When the four parameters: a, c, air, and f, are got from the gf data and the A/F data, their calculations are considerably complicated, thus requiring a fairly long calculation time. Accordingly, a(k), c(k), f(k) and air(k) do not define a, c, f, and air at time k but define the average values of a, c, f, and air used for determining X(k), Y(k) and A/F(k+n) at time k. In approximation, the defined a, c, f, and air are said to be values obtained by the moving average of the real a, c, f, and air. The relational expressions are produced according to this definition.

First of all, an equation (1) is attained from the fuel attachment model.

$$X(k)=d\cdot gf(k)+(a\cdot c-b\cdot d)gf(k-1)+b\cdot X(k-1) \tag{1}$$

Subsequently, an equation (2) is derived from the LPF model.

$$A/F(k+n)=f\cdot Y(k)+c\cdot A/F(k+n-1) \tag{2}$$

An equation (3) takes place by shifting the time in the equation (2) by n.

$$A/F(k)=f\cdot Y(k-n)+e\cdot A/F(k-1) \tag{3}$$

Furthermore, the relationship among X, Y and air is expressible by an equation (4).

$$X(k-n)=\mathrm{air}/Y(k-n) \tag{4}$$

When successively shifting the time in the equations (1) and (2), equations (5) and (6) are given as follows.

$$\begin{aligned}
X(k-n+1)&=d\cdot gf(k-n+1)+(a\cdot c-b\cdot d)gf(k-n)+b\cdot X(k-n)\\
X(k-n+2)&=d\cdot gf(k-n+2)+(a\cdot c-b\cdot d)gf(k-n+1)+b\cdot X(k-n+1)\\
X(k-2)&=d\cdot gf(k-2)+(a\cdot c-b\cdot d)gf(k-3)+b\cdot X(k-3)\\
X(k-1)&=d\cdot gf(k-1)+(a\cdot c-b\cdot d)gf(k-2)+b\cdot X(k-2)\\
X(k)&=d\cdot gf(k)+(a\cdot c-b\cdot d)gf(k-1)+b\cdot X(k-1)
\end{aligned} \tag{5}$$

$$A/F(k+1)=f\cdot Y(k-n+1)+e\cdot A/F(k)$$

$$A/F(k+2)=f\cdot Y(k-n+2)+e\cdot A/F(k+1)$$

$$A/F(k+3)=f\cdot Y(k-n+3)+e\cdot A/F(k+2)$$

$$A/F(k+n-1)=f\cdot Y(k-1)+e\cdot A/F(k+n-2)$$

$$A/F(k+n)=f\cdot Y(k)+e\cdot A/F(k+n-1) \quad (6)$$

In the equations (5) and (6), A/F(k), A/F(k−1) and gf(k), gf(k−1), . . . gf(k−n+1), gf(k−n) are data deeply connected to each other and therefore are known. Setting temporary values to the parameters a, c, f, and air, the parameters b, d and e are first obtainable. Further, Y(k−n) is given from the equation (3), while X(k−n) is given from the equation (4).

Secondly, X(k−n) is substituted into the equation (5) to successively calculate X(k−n+1), X(k−n+2), . . . , X(k−1) and X(k), and then Y(k−n+1), Y(k−n+2), . . . , Y(k−1) and Y(k) are derived from the equation given by shifting the time in the equation (4). The resulting Y(k) and A/F(k) are substituted into the equation (6) to successively calculate A/F(k+1), A/F(k+1), . . . , A/F(k+n−1), A/F(k+n).

The calculated A/F(k+n) does not always coincide with the measured A/F(k+n), for that the set a, c, f and air are temporary values but not equaling the correct a, c, f and air. Accordingly, an evaluation function is produced to output the absolute value of the difference between the calculated A/F(k+n) and the measured A/F(k+n), and a combination of a, c, f and air is made to minimize the value of the evaluation function. The content of the evaluation function is an equation which is for successively obtaining the aforesaid X, Y and A/F to calculate the difference between the obtained A/F(k+n) and the measured A/F(k+n). The simplex algorithm is employed for obtaining a, c, f and air. In this instance, the air-fuel ratio sensor delay n is necessary. This delay n at every speed was found from the result of calculating the cross-correlation function between Δgf and ΔA/F or from the step response of gf relative to A/F. At 2000 rpm, it was 12, and at 3000 rpm, it was 15.

In the case of the prior art disclosed in Japanese Unexamined Patent Publication No. 3-235723, the variation of n creates a problem. More specifically, the dimension of the transfer matrix varies with the n value or the dimension of the matrix needs to be set to the maximum value of n, and hence there is a possibility that the coefficient comparison calculation amount in the pole assignment method significantly increases.

Figure 6:
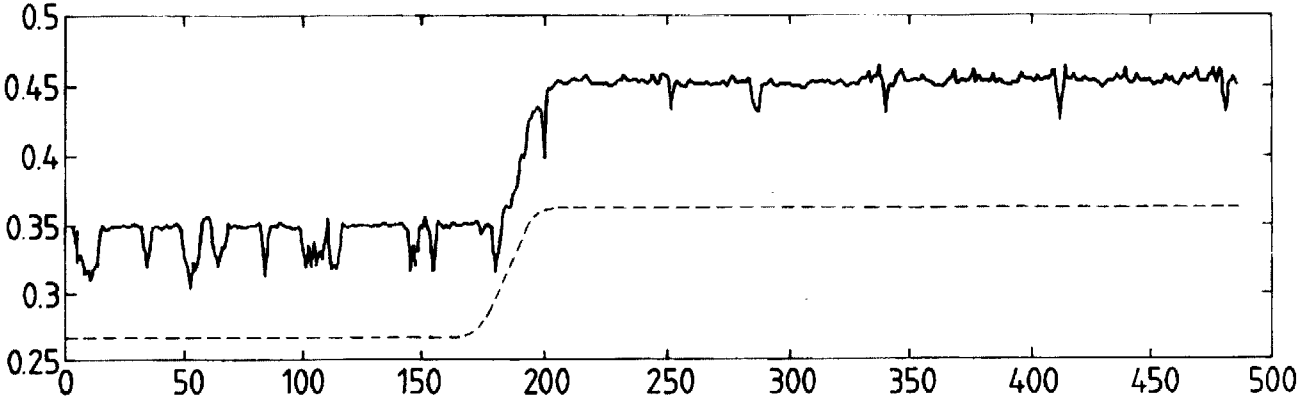
FIG. 6 is an illustration useful for describing a fuel attachment rate in the same embodiment.

FIG. 6 shows the results of the fuel attachment rate a obtained on the basis of the data collected when in a four-cylinder engine the opening degree of its throttle valve varies, where the engine speed is 2000 rpm and and the data used are measured in a state that the engine speed is maintained constant by changing the load in accordance with the engine torque. In the illustration, the horizontal axis represents a TDC while the vertical axis signifies a fuel attachment rate. For reference, the variation of the throttle opening degree th is additionally indicated by a dotted line, and the vertical axis is scaled. Although, in the case that the fuel injection quantity gf is constant, it is logically impossible to find a, c, and f in accordance with the above-mentioned method, in the case of the actual data the fuel injection quantity gf slightly varies. Thus, the simplex method is adopted in order to obtain the values a, c, and f.

Figure 7:
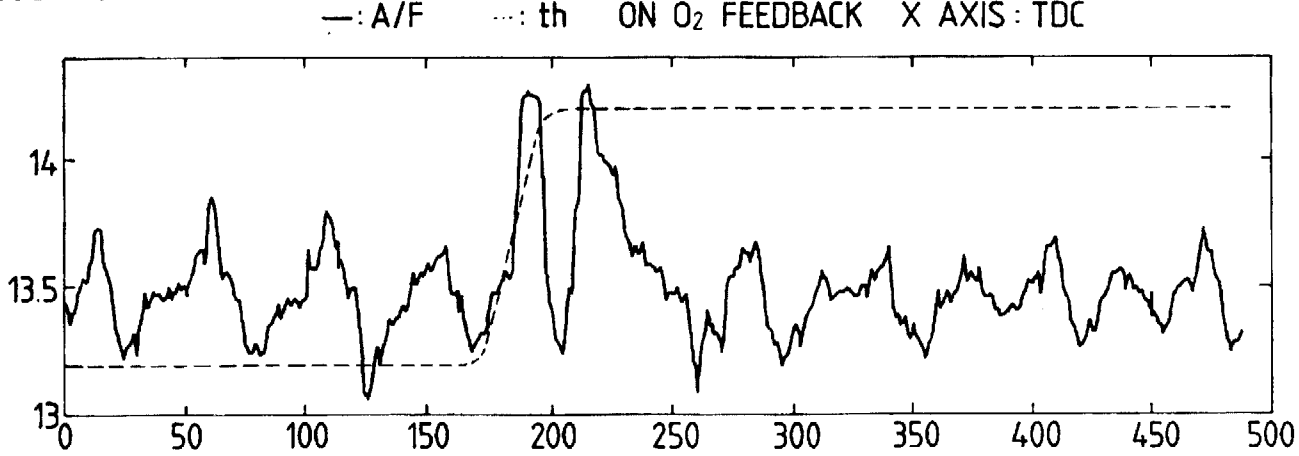
FIG. 7 is an illustration useful for explaining an exhaust gas air-fuel ratio measured in the FIG. 1 embodiment.

FIG. 7 shows the measurement data of the air-fuel ratio. The engine being a controlled object is equipped with an $O_2$ sensor serving as an air-fuel ratio sensor, and because of the PIFB using the $O_2$ sensor, the A/F varies even in a state that the throttle opening degree does not vary. Needless to say, the fuel injection quantity gf also is waving. In FIG. 7, as well as FIG. 6 the horizontal axis denotes the TDC, while the vertical axis depicts the air-fuel ratio. In this engine, it is found that the air-fuel ratio is controlled to approximately 13.5. In addition, as well as FIG. 6, the throttle opening degree is additionally indicated therein.

Figure 8:
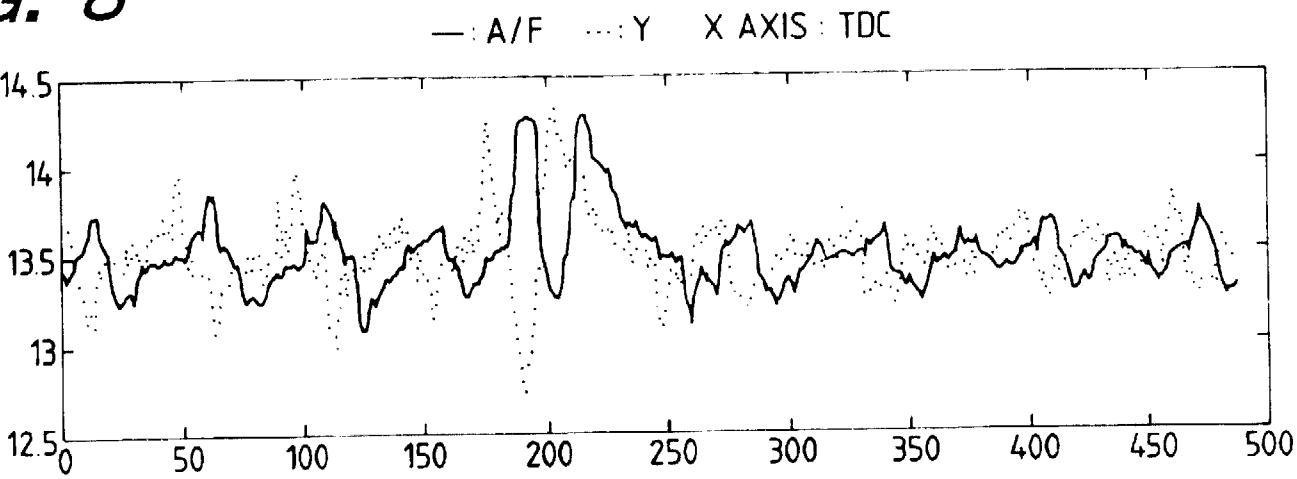
FIG. 8 is an illustration available for describing an in-cylinder air-fuel ratio calculated in the FIG. 1 embodiment.

FIG. 8 illustrates the data of the obtained in-cylinder air-fuel ratio Y concurrently with indicating the exhaust gas air-fuel ratio A/F, where the horizontal axis represents the TDC and the vertical axis signifies the air-fuel ratio, while the in-cylinder air-fuel ratio Y is indicated by a dotted line and the exhaust gas air-fuel A/F is shown by a solid line. It is found from the illustration that the exhaust gas air-fuel ratio A/F is delayed by 13 TDC with respect to the in-cylinder air-fuel ratio Y and the exhaust gas air-fuel ratio A/F develops an irregular waveform in relation to that of the in-cylinder air-fuel ratio Y. Thus, it is possible to know the behavior of the in-cylinder air-fuel ratio at the data measurement. The NN is constructed to estimate the in-cylinder air-fuel ratio Y through the use of the in-cylinder air-fuel ratio Y as an educator signal, thus estimating the in-cylinder air-fuel ratio Y.

Figure 9:
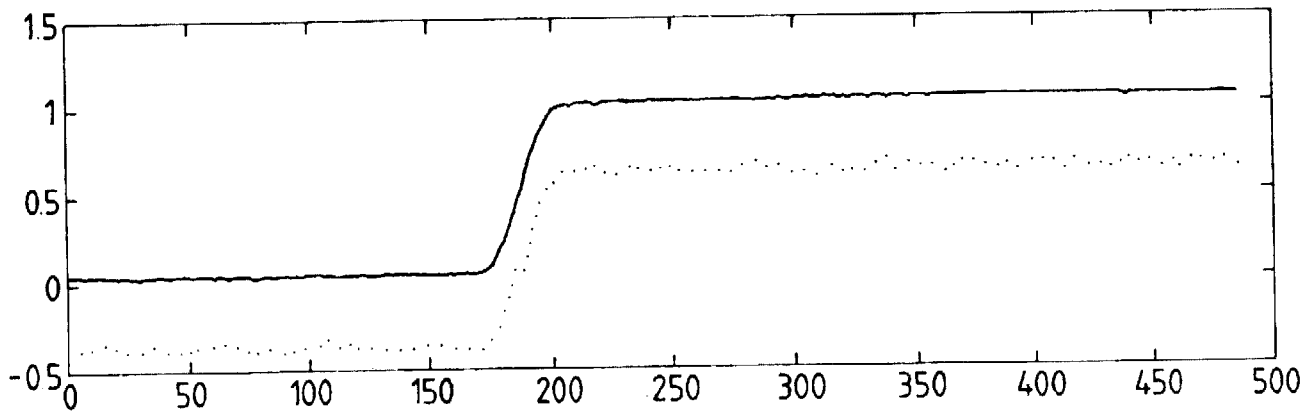
FIG. 9 is an illustration of the relationship between an intake (manifold) pressure and an air quantity calculated in the FIG. 1 embodiment.

As the information for determining the quantity of air flowing the cylinder and the operating state, the air quantity estimating information is first selected as the input to the NN, whereas it needs to show a high correlation relative to the air quantity into the cylinder. FIG. 9 illustrates the intake pressure pb within the intake manifold and the air quantity air into the cylinder obtained through the calculation, where the horizontal axis represents the TDC while the solid line signifies the intake pressure and the dotted line denotes the air quantity air. The vertical axis is scaled for easy viewing. As obvious from the illustration, the correlation therebetween is extremely high. Thus, although the other information is also inputted for fine correction, the air quantity into the cylinder is almost expressible by the intake pressure.

Although not shown, there are the differences in time and graph configuration between the throttle opening degree th and the air quantity air and there is no high correlation therebetween. However, depending upon the fitting position of the pb sensor and the engine characteristic, there is a possibility that the correlation between pb and air is broken. Particularly, pb can be delayed with respect to air. In this case, there may be a need for producing information with a high correlation with air to add it to the input of the NN.

Furthermore, a description will be taken hereinbelow of information for determining the fuel quantity X flowing into the cylinder. Looking at the fuel attachment model of FIG. 5, the input for determining the fuel quantity X into the cylinder is the fuel injection quantity gf. In the case that the internal coefficients a, b, c, and d are known in advance, if the fuel quantity X(k−m) at the past time k−m (m>0) and the values gf(k−m) to gf(k) from the time k−m to the time k are known, the determination of X(k) is possible. However, difficulty is experienced to measure the past K(k−m). On the other hand, the effect of the attached fuel reduces with the passage of time. That is, the rate of the fuel attachment at the last fuel injection but m−1 (the $m^{th}$ fuel injection from the present fuel injection) being included in the present fuel quantity into the cylinder is $a*b^{m}*c$, and since all the coefficients are within the range from 0 to 1, the value from the equation approaches 0 as m increases. In fact, from the calculations of 30000 or more combinations of a and c obtained on the basis of the data at 2000 rpm to 3000 rpm, it was found that the error converges to within several % at m=5. Accordingly, the fuel injection quantities gf(k−5) to gf(k) was determined to be used for the determination of X(k).

In this way, the input item to the NN is determined, and the learning is made in a state that the in-cylinder air-fuel ratio Y is used as the educator signal. However, all the in-cylinder air-fuel ratios Y were not used as the educator signals but the data were extracted from around a portion where the throttle opening degree varies and used as the educator signals. This is because the time required for the learning lengthens as the number of the educator signals increases and the rate of the steady-state data extremely increases as compared with that of the transient state data. The learning relies on the common back-propagation. The learning results are stored in a ROM (Read-Only memory) of the engine controller, and the first-mentioned control sequence is carried out by the CPU of the engine controller.

Incidentally, a description will also be made of the calculation amount. The number of calculations in the NN is relatively large. However, although the number of multiplications is large but the number of multiplications performed continuously is small, and even the coefficients undergoing the multiplication in the interior of the NN are fixed values. This means making it easy to shorten the number of the arithmetic words and making it possible to substantially reduce the calculation amount. The continuous multiplications tend to give rise to a problem in arithmetic accuracy. With the calculation in the interior of the NN, they are made three times (the input coefficient in the intermediate hierarchy, the sigmoid function in the intermediate hierarchy and the input coefficient in the output hierarchy), and since the the values are known, the range of the calculation values is also known, besides the calculation finishes within the control cycle, with the result that the verification of the arithmetic accuracy is simplified. On the other hand, in the case of the adaptive control, one identification involves approximately five continuous multiplications and the convergence calculation exceeds the control cycle, and hence the verification of the arithmetic accuracy becomes hard. Accordingly, in the case of the adaptive control, there is a great possibility that the floating-point arithmetic becomes necessary.

Figure 10:
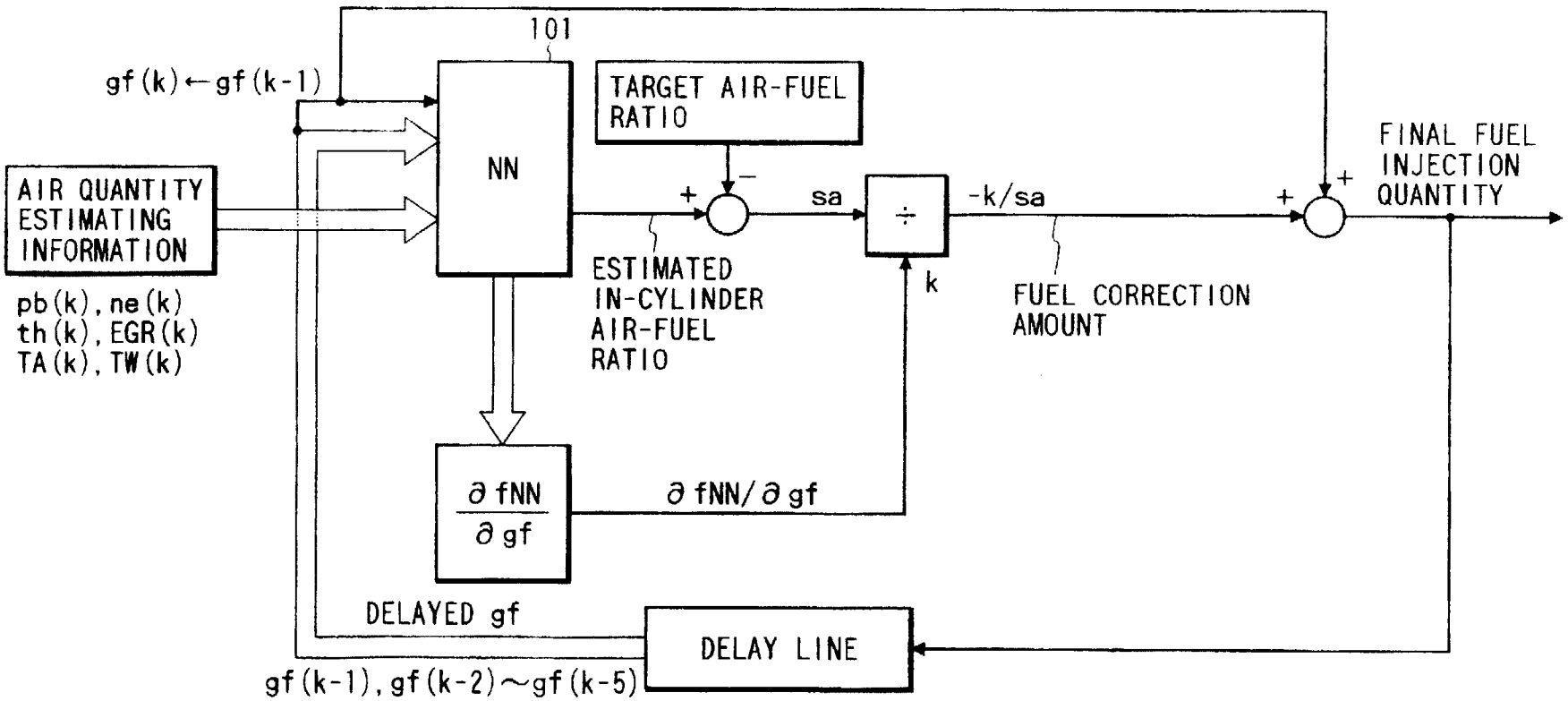
FIG. 10 is a block diagram showing an air-fuel ratio control system according to another embodiment of the present invention.

Secondly, a description will be made hereinbelow of an air-fuel control system according to a second embodiment of this invention with reference to a control block diagram of FIG. 10. The FIG. 10 embodiment differs from the FIG. 1 embodiment in that the fuel injection quantity gf(k−1) preceding by 1 TDC is employed in place of the constant value used in the FIG. 1 embodiment. In FIG. 10, an NN 101 constitutes a nonlinear function, and hence the accuracy of this control system improves as the fuel injection quantity gf being an input to the NN 101 is closer to the final fuel injection quantity. Thus, when the fuel injection quantity gf is a regular value, the control performance can deteriorate. In this case, the estimation accuracy of the NN 101 is raised through the utilization of the fact that the difference between gf(k) and gf(k−1) is relatively little. The other operations and principles are the same as those of the FIG. 1 embodiment. For a further improvement, since the same value is always applied as gf(k) and gf(k−1) to the NN 101, it is appropriate to unify the input layers or the intermediate layers on the basis of the learning results so that the number of inputs to the NN 101 decreases and the load on the CPU reduces.

Figure 11:
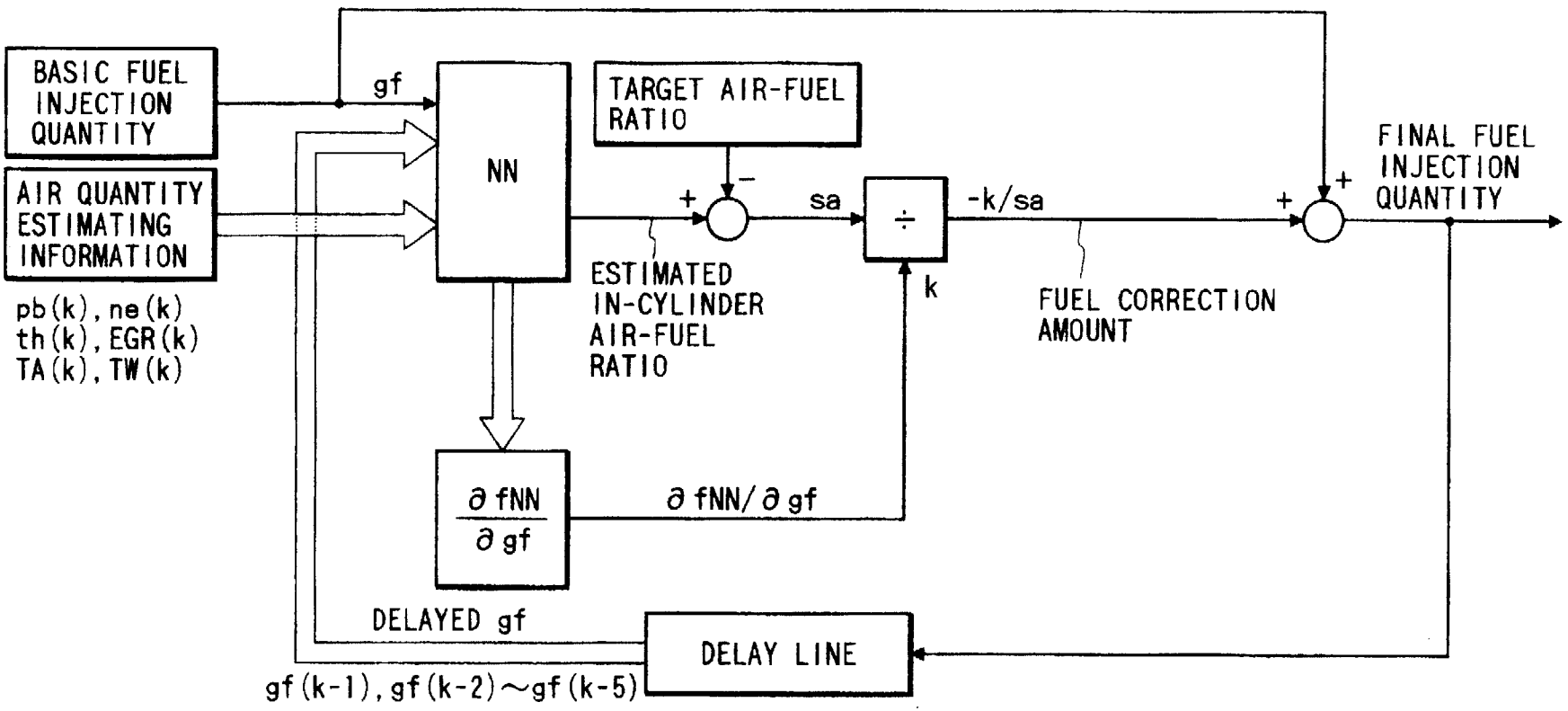
FIG. 11 is a control block diagram showing an air-fuel ratio control system according to a further embodiment of the present invention.

FIG. 11 is a control block diagram showing an air-fuel ratio control system according to a third embodiment of the present invention. The prior fuel injection control also employs the idea about the basic fuel injection quantity, wherein the fuel injection quantity is determined in an FF fashion through a table or an empirical formula for a fuel injection quantity calculation on the basis of the parameters such as the throttle opening degree th and the intake pressure pb within the intake manifold.

On the other hand, in FIG. 11, in place of the constant value of FIG. 1 the fuel injection quantity gf(k−1) of FIG. 10 is used as the basic fuel injection quantity. As described in the FIG. 10 embodiment, the FIG. 11 embodiment has superiority over the FIG. 1 method. Further, the FIG. 11 method faces the difficulty to directly control the fuel injection quantity gf and, hence, can fall into unsatisfactory control. For this reason, for putting the FIG. 11 method into practical use, a considerably large amount of verification test on the stability becomes necessary. Particularly, in the case of an unproven system being still in a developing stage, the sudden control malfunction may make the debugging difficult and extremely impair the development efficiency. However, in the FIG. 11 method the basic fuel injection quantity close to the ideal fuel injection quantity is always inputted therein, if there is no oscillation of the control loop, the operation becomes stable. Further, if monitoring the basic fuel injection quantity and the fuel correction amount, the confirmation of the operation and the debugging become easy. Still further, if the fuel correction amount is set to zero, the minimum operating state can at least be established at any time and the development efficiency comes to satisfaction. For the same reason, the stability verification becomes easy.

Furthermore, referring to FIG. 12 a description will be taken hereinbelow of an air-fuel ratio control system according to a fourth embodiment of the present invention. This structure is very simple, and an NN 121 accepts as inputs the air quantity estimating information such as pb(k) and the previous fuel injection quantity such as gf(k−1). The output of the NN 121 is the final fuel injection quantity which is directly used as the present fuel injection quantity. The NN 121 differs in structure from that of FIG. 4, and the difference is that the number of the input layers reduces by one and come to 11 because of no present fuel injection quantity gf(k) and its output does not produce the in-cylinder air-fuel ratio estimation quantity but creating the present fuel injection quantity gf(k). A description will be taken about the learning method of the NN 121.

Figure 13:
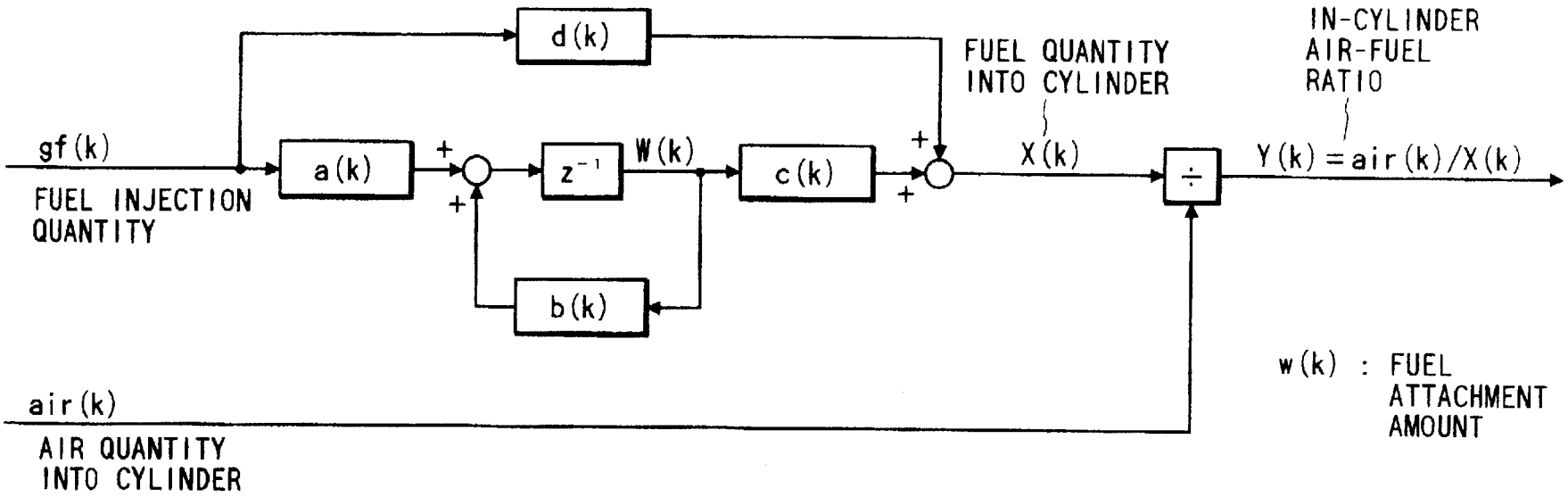
FIG. 13 is an illustration available for describing a fuel attachment mechanism in the embodiments.

FIG. 13 illustrates the fuel attachment model section expressing the fuel attachment mechanism drawn out from FIG. 5, where the (k) index is added to the parameters such as a and b for correct expression and w(k) represents a fuel attachment amount. From this illustration, the following function is obtainable as an equation (7).

$$gf(k)\cdot d(k)+w(k)\cdot c(k)=X(k) \tag{7}$$

$$44w(k)=\frac{X(k)-gf(k)\cdot d(k)}{c(k)}$$

As described in the above embodiments, since c(k), d(k) and X(k) in the taken data, which vary with the time, are obtained, w(k) that varies with the time is given from the equation (7) (omitting (k) hereinafter). On the other hand, the relationship to the in-cylinder air-fuel ratio Y is expressible by the following equation (8).

$$\begin{aligned} Y(k) &= \frac{\mathrm{air}(k)}{X(k)} \\ &= \frac{\mathrm{air}(k)}{gf(k)\cdot d(k)+w(k)\cdot c(k)} \end{aligned}$$

Now, let us discuss about the ideal fuel injection quantity gfm(k). The ideal signifies that, when an amount of fuel is injected into a cylinder at time k, the in-cylinder air-fuel ratio comes to the ideal air-fuel ratio YY. The following equation (9) is produced by the replacement of the Y(k) with YY.

$$YY = \frac{\text{air}(k)}{gfm(k) \cdot d(k) + w(k) \cdot c(k)} \tag{9}$$

$$\therefore gfm(k) = \frac{1}{d(k)} \left( \frac{\text{air}(k)}{YY} - w(k) \cdot c(k) \right)$$

Thus, the ideal fuel injection quantity gfm is attainable. The NN 121 learns with this gfm being used as an educator signal.

Figure 14:
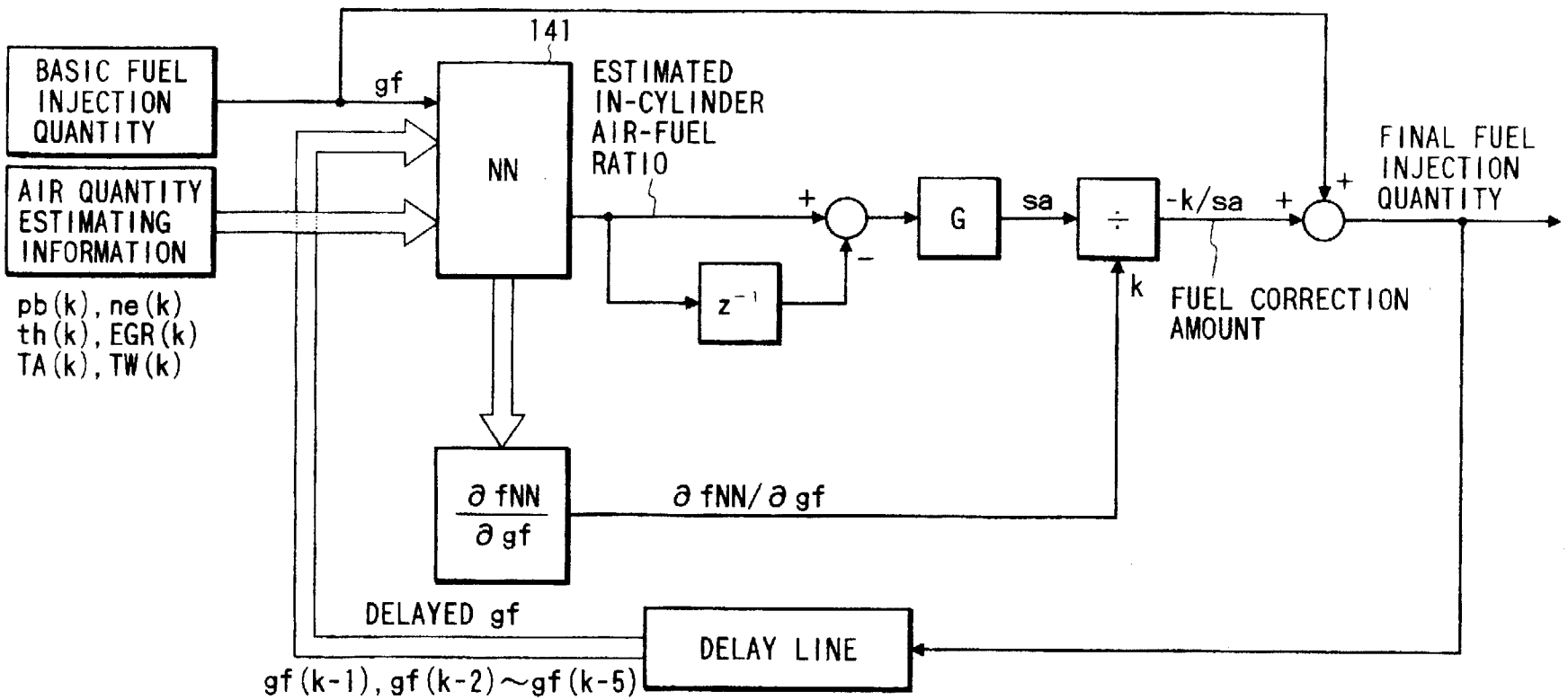
FIG. 14 is a control block diagram showing an air-fuel ratio control system according to a further embodiment of the present invention.

Still further, a description will be taken hereinbelow of an air-fuel ratio control system according to a fifth embodiment of the present invention with reference to the control block diagram of FIG. 14. Although being similar to the FIG. 11 system, the difference of the FIG. 14 system from the FIG. 11 system is to take the last difference of the estimated in-cylinder air-fuel ratio being the output of an NN 141. This corresponds to the differentiation or derivation in the continuous system, and is used for suppressing the rapid variation of the in-cylinder air-fuel ratio. More specifically, the oxygen quantity estimating formation is applied to an engine model produced on the basis of the fuel attachment mechanism that makes fuel attached to the intake manifold and the time delay between the moment a fuel injection into the cylinder takes place and the moment the air-fuel ratio sensor responds to the exhaust gas for sensing said exhaust gas air-fuel ratio, to calculate an internal coefficient of the engine model and an air-fuel ratio within the cylinder. An NN 141 accepts the oxygen quantity estimating information and the fuel injection quantity and further learns the calculated in-cylinder air-fuel ratio to learn the relationship among the oxygen quantity estimating information, the fuel injection quantity and the calculated in-cylinder air-fuel ratio. Further, the NN 141 is responsive to the oxygen quantity estimating information varying with time and the fuel injection quantity to estimate an in-cylinder air-fuel ratio on the basis of these inputs, and outputs the estimated in-cylinder air-fuel ratio. Then, that estimated in-cylinder air-fuel ratio from the NN 141 is subjected to the differentiation to obtain a differential value and further undergoes the partial differential with respect to the fuel injection quantity. The differential value is divided by the partial differential value to calculate a fuel injection correction amount whereby the in-cylinder air-fuel ratio coincides with the previous in-cylinder air-fuel ratio, and the calculated duel injection correction amount is added to a basic fuel injection quantity to obtain the fuel injection quantity to be actually supplied into the cylinder, with basic fuel injection quantity being obtained through a table or empirical formula preset on the basis of the oxygen quantity estimating information and being used as the current fuel injection quantity.

This operation is equivalent to the D (differential) control action of the so-called PID control. Further, in the illustration, character G designates a coefficient corresponding to the coefficient for the D control action thereof, while the value of G is required to be below 1 if taking the stability of the system into consideration. The NN 141 does not have influence on the low-frequency characteristic in this system. The low-frequency of the fuel injection quantity relies upon the basic fuel injection quantity.

Moreover, a description will be made hereinbelow of an air-fuel ratio control system according to a sixth embodiment of this invention with reference to the schematic control block diagram of FIG. 15. In the FIG. 15 system, the final fuel injection quantity, calculated in the FIG. 1, 10 or 12 system, is not directly used but is treated as a fuel injection quantity determined through the NN application control (in FIG. 15), with the basic fuel injection quantity being subtracted therefrom. The difference (which will be referred hereinafter to as a basic fuel correction amount) therebetween passes through a limiter 151 and a switch 152, which act as limiting elements, to be again added to the basic fuel injection quantity, thus resulting in the real final fuel injection quantity. Since the basic fuel injection quantity is set so that the air-fuel ratio equals the target air-fuel ratio in the steady state, in the steady state the basic fuel correction amount is approximately zero. On the other hand, the basic fuel injection quantity is shifted from zero in the transient condition in which the throttle opening degree varies.

Let it be assumed that the NN system takes an abnormal action due to some circumstance. In this instance, the basic fuel correction amount is expected to be greatly shifted from zero. In addition, even in the steady state the basic fuel correction amount is expected to continuously assume values apart from zero. Thus, if such a phenomenon is detected to determine the abnormality of the NN system and the basic fuel correction amount is set to zero or a value close to zero, it is possible to prevent the final fuel injection quantity from taking an abnormal value or to prevent it from continuously assuming an abnormal value. For example, a control test is performed in a state that the switch 152 is in the ON condition without using the limiter 151 so that the value of the basic fuel correction amount is monitored when being in the transient condition. Then, the upper and lower limits of the limiter 151 are determined on the basis of the maximum and minimum values of the basic fuel correction amount. More specifically, when the basic fuel correction amount goes out of a range (the range between the upper and lower limits), the upper and lower limits are set to the resultant maximum and minimum values. Accordingly, even if the NN system comes into an abnormal condition, the abnormal operation of the engine is preventable. Further, in the case that it stays out of this range for a given period of time, a decision is made to that the NN system comes to breakdown and the switch 152 is turned off so that the final fuel injection quantity is determined on the basis of only the basic fuel injection quantity without the use of the NN system. Although various concrete algorithms against the abnormalities can readily be considered in the case of employing the FIG. 15 structure, in this specification only a simple example was described above.

Figure 12:
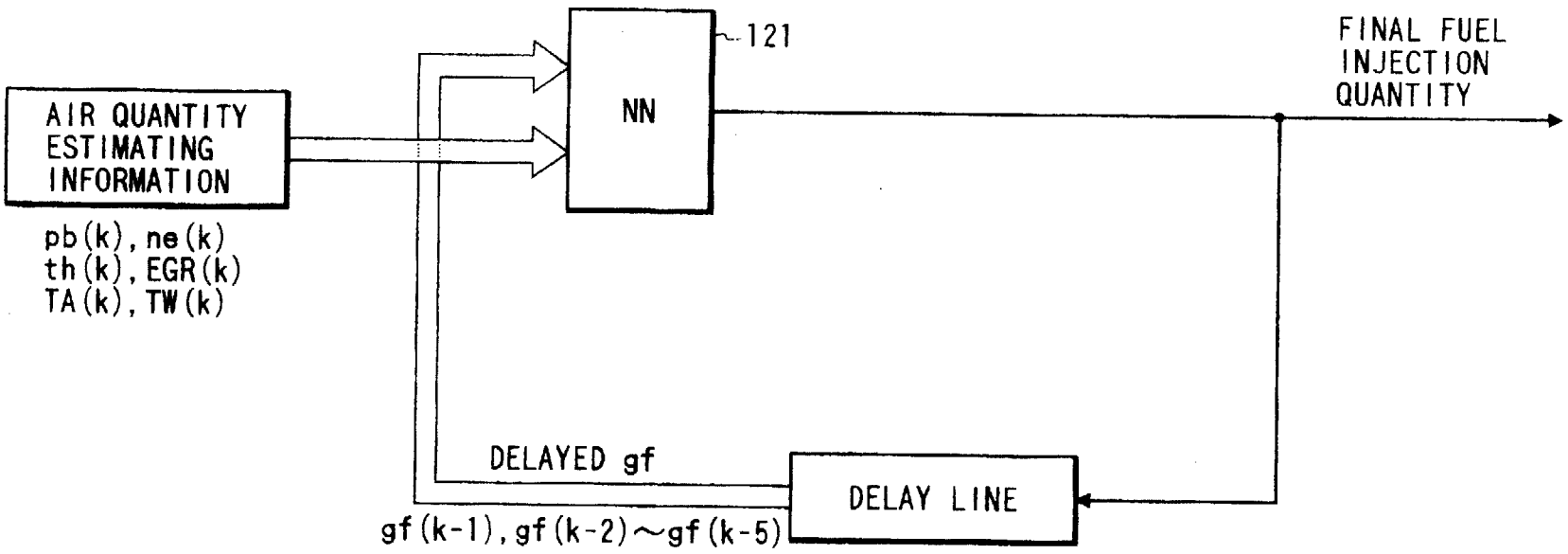
FIG. 12 is a control block diagram showing an air-fuel ratio control system according to a further embodiment of the present invention.
Figure 15:
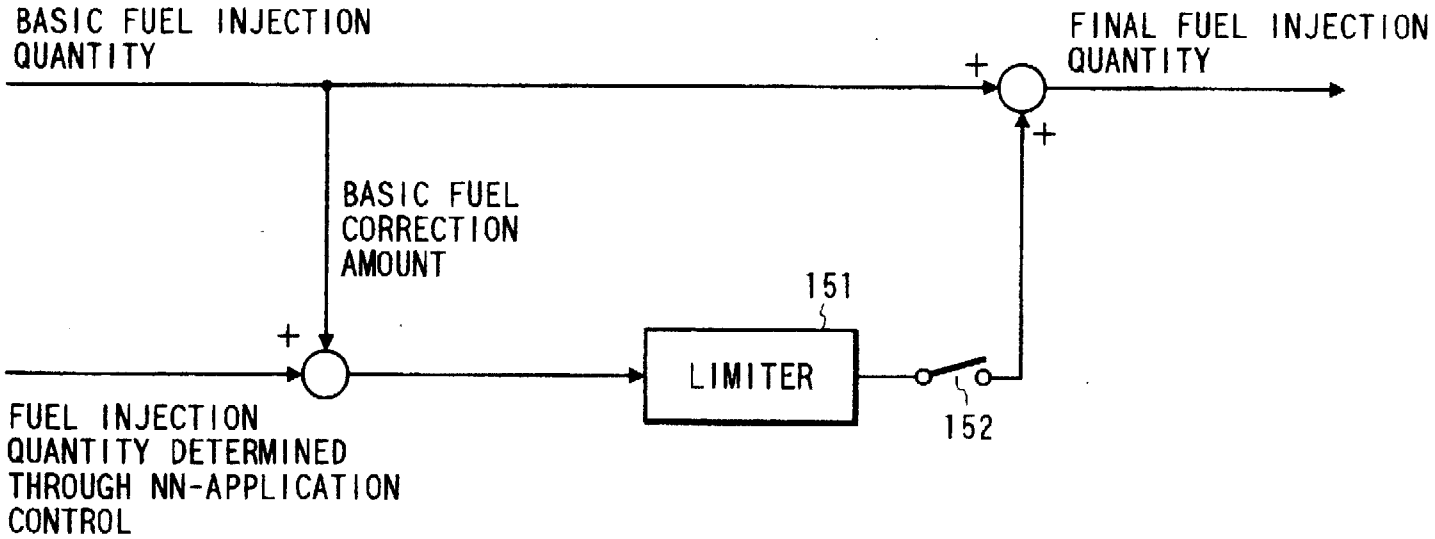
FIG. 15 is a control block diagram schematically showing an air-fuel ratio control system according to a further embodiment of the present invention.
Figure 16:
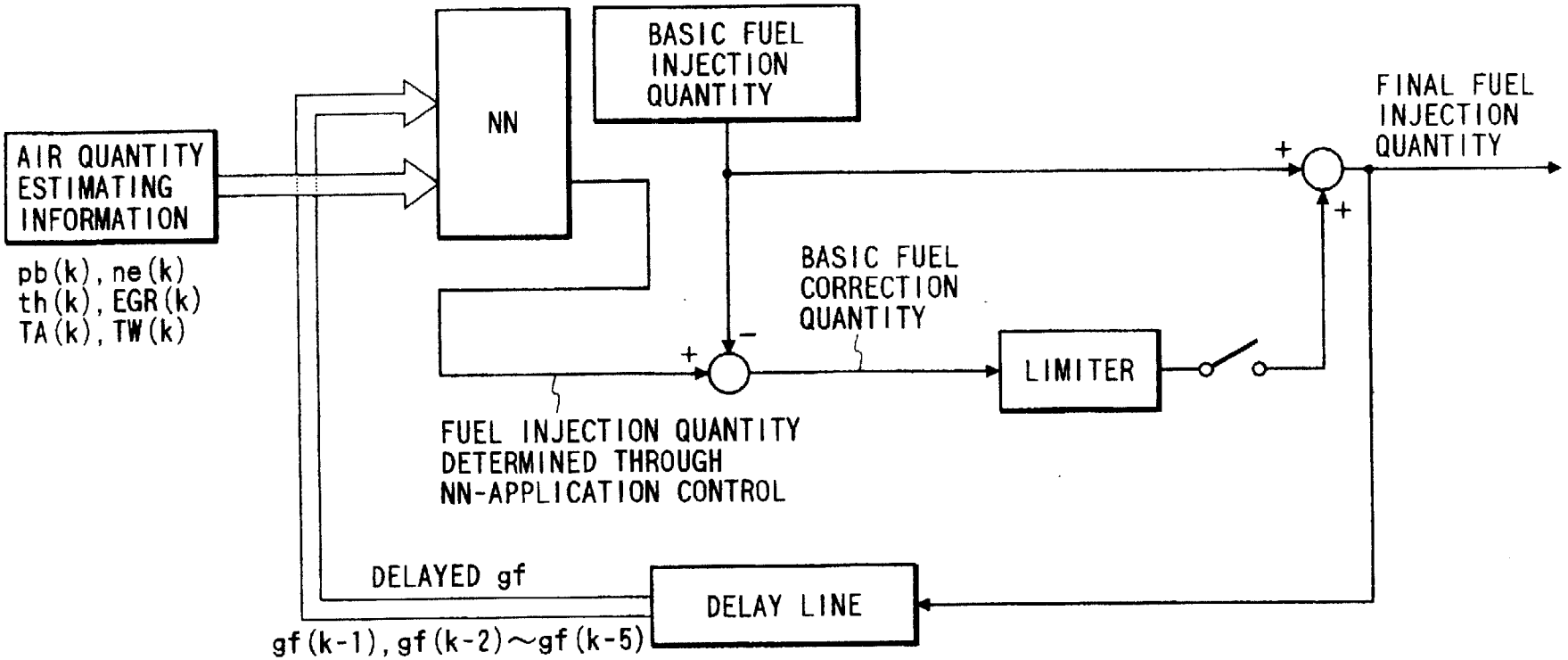
FIG. 16 is a block diagram wholly showing a control structure in the embodiments.
Figure 17:
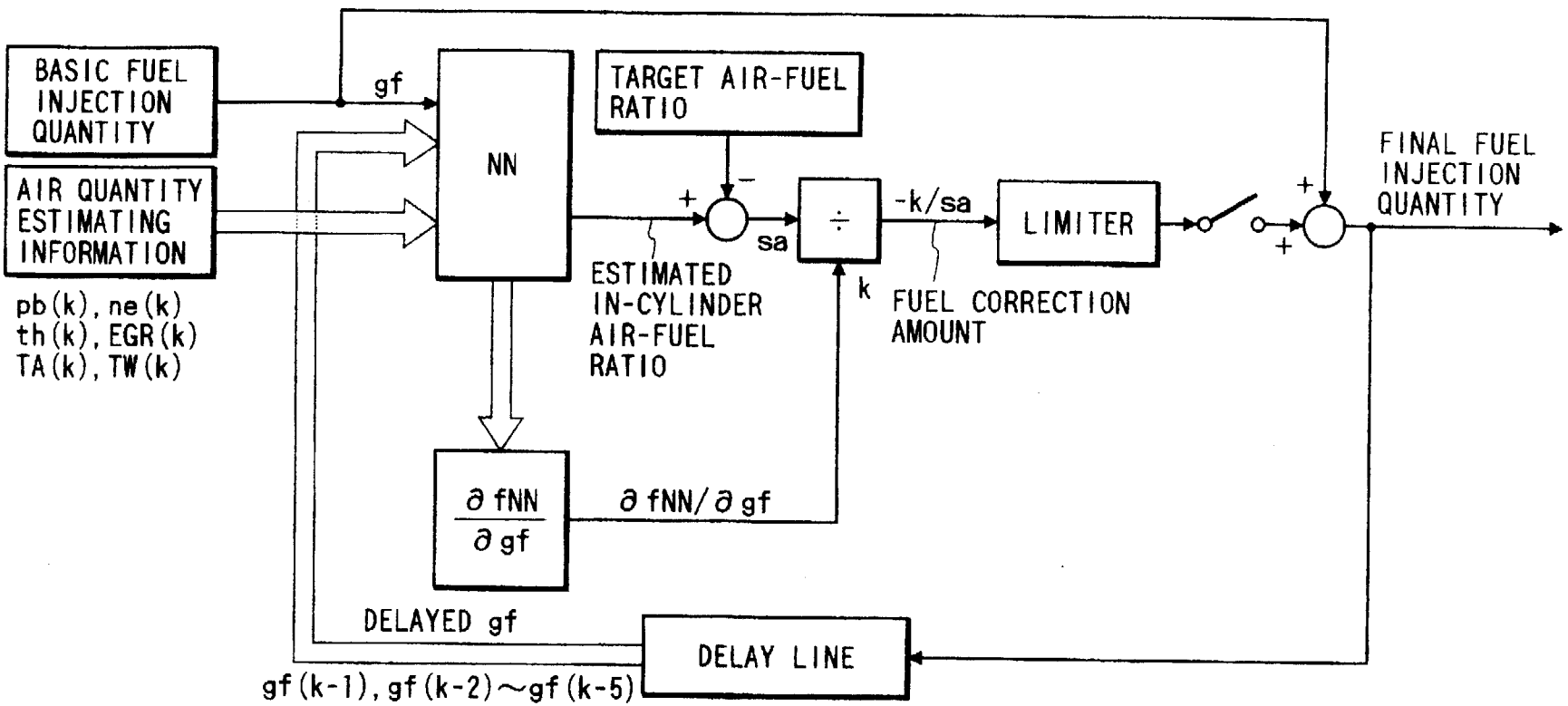
FIG. 17 is a block diagram wholly showing a different control structure in the embodiments.

FIG. 16 wholly shows a combination of the FIG. 12 control system and the FIG. 15 structure, and FIG. 17 entirely shows a combination of the FIG. 11 control system and the FIG. 15 structure. In FIG. 17, there is no means to calculate the basic fuel correction amount given through the subtraction of the basic fuel injection quantity. This is because in the FIG. 11 structure the fuel correction amount determined in the NN system is originally made to be added to the basic fuel injection quantity.

Figure 18:
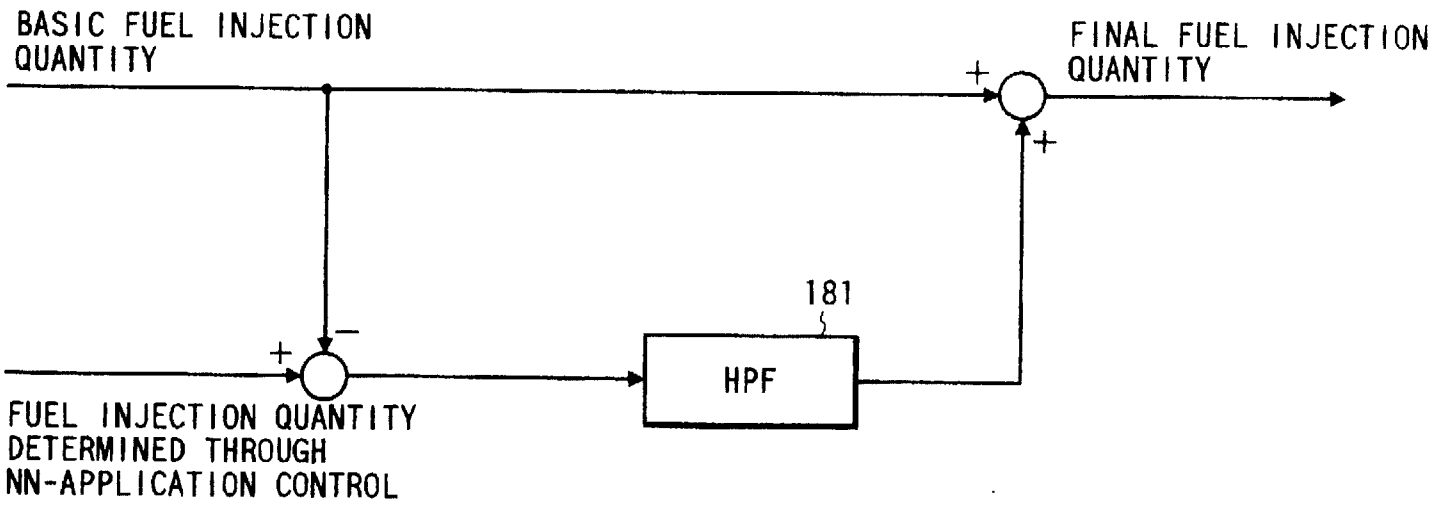
FIG. 18 is a control block diagram schematically showing an air-fuel ratio control system according to a further embodiment of the present invention.
Figure 19:
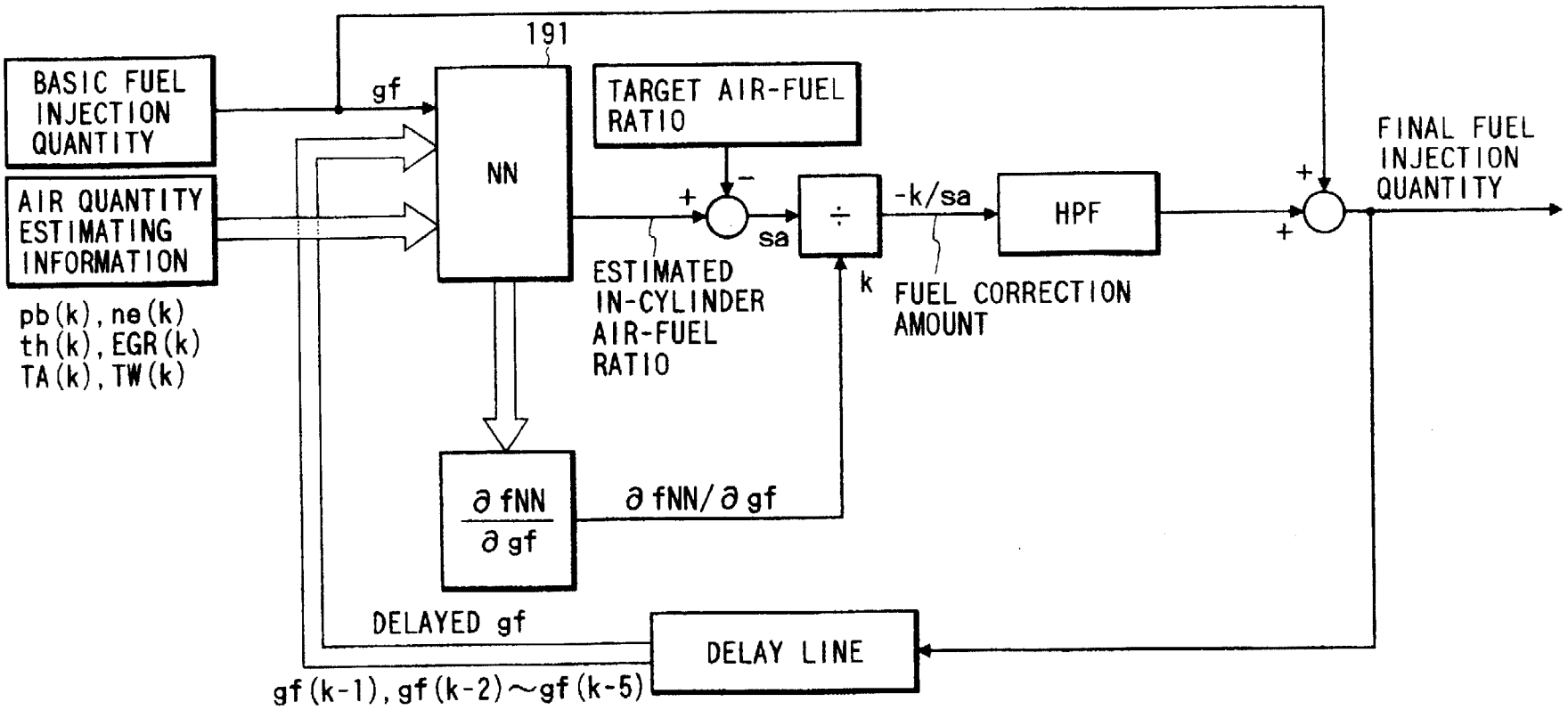
FIG. 19 is a block diagram entirely showing a different control structure in the embodiments.
Figure 20:
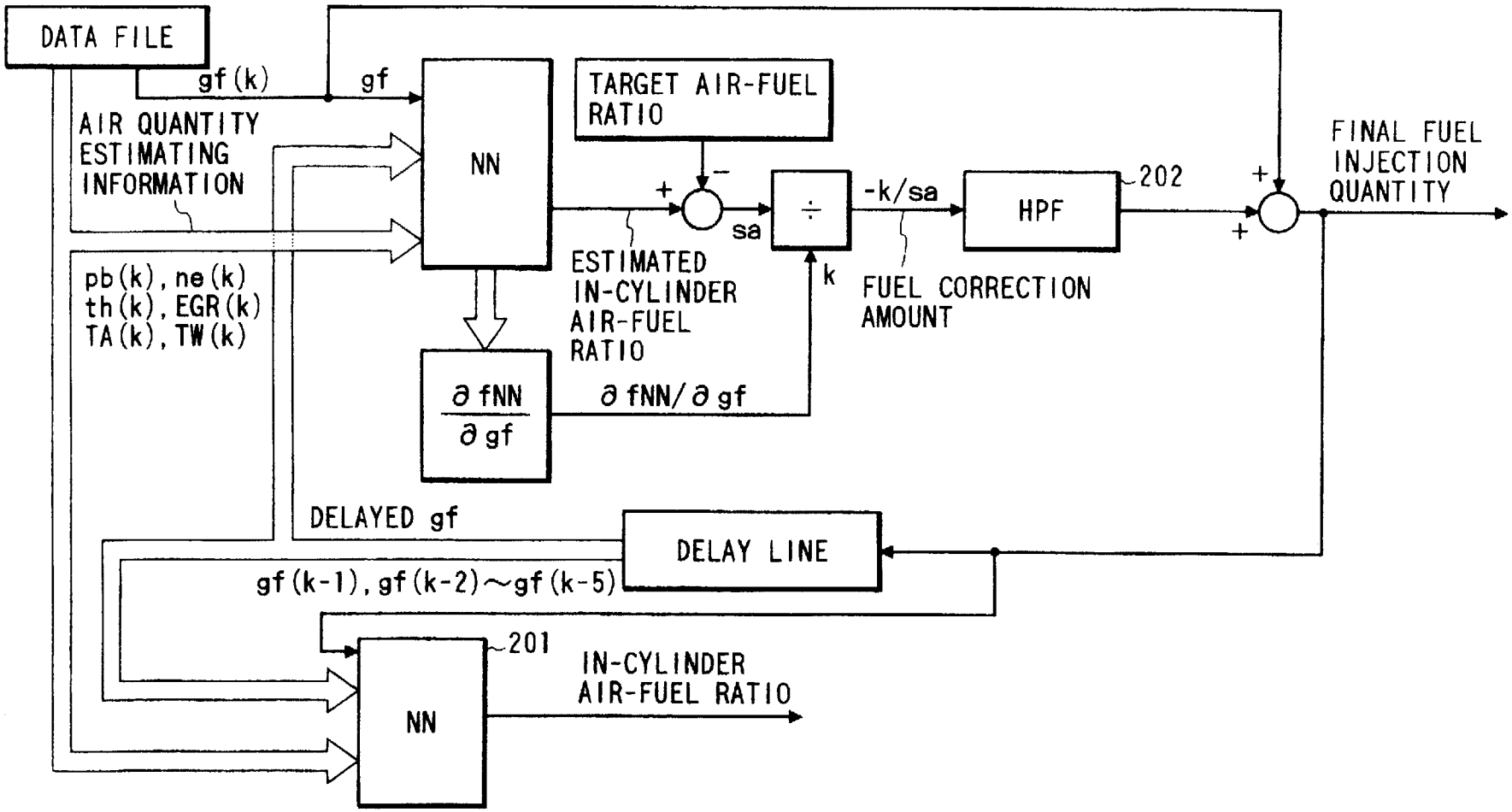
FIG. 20 is an illustration of the entire simulation in the embodiments.

Moreover, referring to FIG. 18 a description will be made hereinbelow of an air-fuel ratio control system according to a seventh embodiment of this invention. This air-fuel ratio control system is designed such that a high-frequency pass filter (HPF) 181 is put in the same place as the limiter 151 and the switch 152. The operation is similar to that of the FIG. 14 air-fuel ratio control system, while this system uses only the high-frequency component of the basic fuel correction amount. FIG. 19 entirely shows a combination of the FIG. 18 system and the FIG. 11 control system. A simulation is as follows. For seeing the results of the FIG. 19 control, the comparison with the prior example in the in-cylinder air-fuel ratio is preferable. Since the FIG. 19 system calculates only values up to the final fuel injection quantity, the in-cylinder air-fuel ratio is derived through an NN 191 that completes the learning. FIG. 20 is an whole illustration of the simulation. In its lower section, there is placed an NN 201 which accepts as inputs the fuel injection quantity gf, the past fuel injection quantity gf and the air quantity estimating information. The in-cylinder air-fuel ratio being the output of the NN 201 is subjected to evaluation. Further, the fuel injection quantity at the test (the PI feedback of the $O_2$ sensor) is used as the basic fuel injection quantity. The time constant of a HPF 202 is ser to 30 TDC and the engine speed is set to 2000 rpm.

Figure 21:
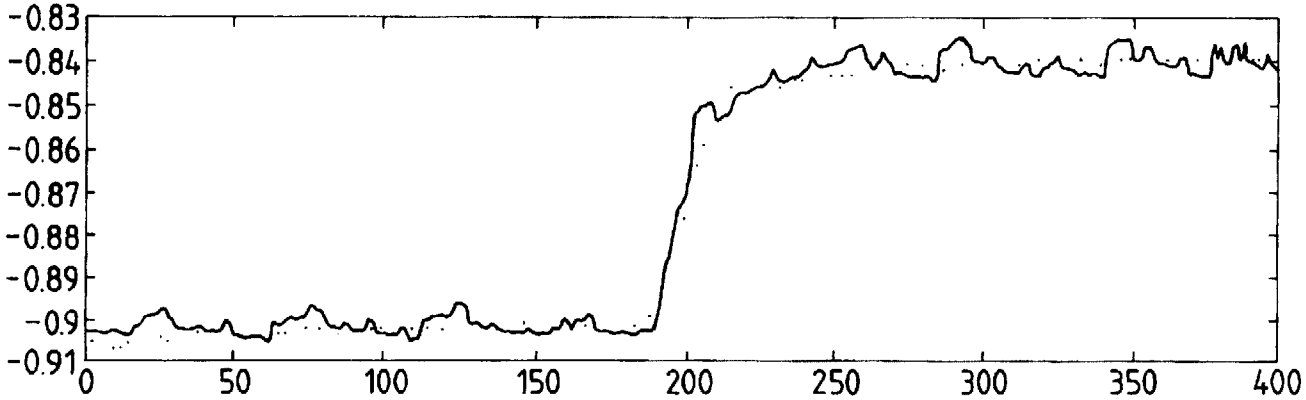
FIG. 21 is an illustration useful for explanation of a fuel injection quantity in the embodiments.
Figure 22:
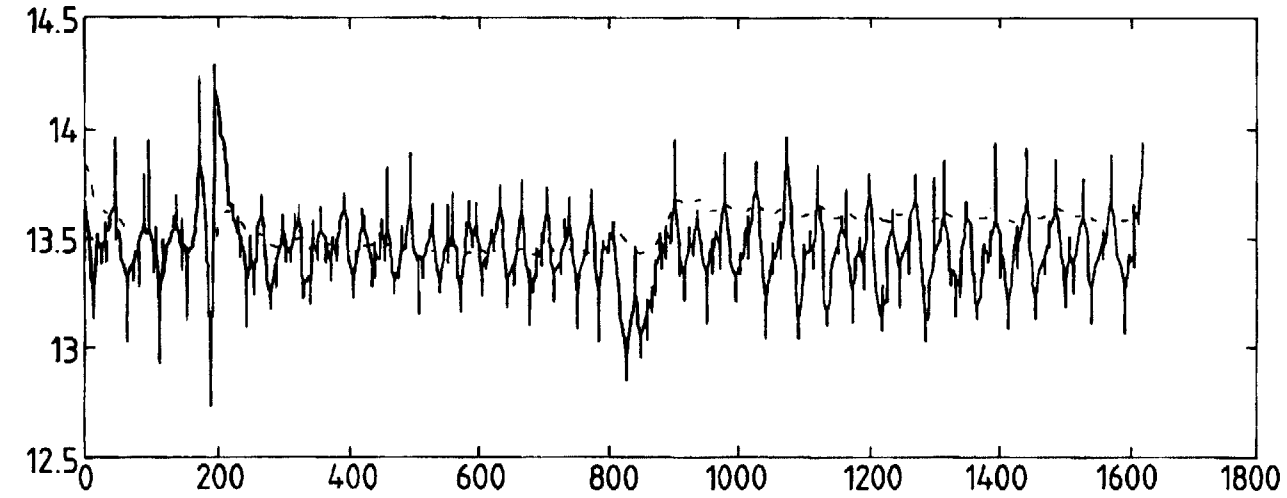
FIG. 22 is an illustration useful for description of an in-cylinder air-fuel ratio in the embodiments.

FIG. 21 illustrates the transition of the fuel injection quantity. For easy viewing, the results up to 400 TDC are shown in enlargement. In the illustration, the solid line represents the fuel injection quantity at the test and the dotted line denotes the control simulation result, while the horizontal axis indicates the TDC and vertical axis signifies a dimensionless number normalized. As obvious from the illustration, the simulation result shows less variation. FIG. 22 shows the comparison result of the in-cylinder air-fuel ratio, where the solid line represents the in-cylinder air-fuel ratio at the test previously obtained through the calculation and the broken line indicates the control simulation result. As obvious from the illustration, the NN-used control can considerably suppress the variation of the air-fuel ratio. At the test the air-fuel ratio is controlled to be approximately 13.5 on average and the target air-fuel ratio is set to 14 during the simulation, whereupon at the starting the broken line slowly varies from 14 to the vicinity of 13.5. This is due to the HPF effect. The NN control does not respond to a slow variation above 30 TDC. In the illustration, the opening of the throttle valve takes place in the vicinity of 200 TDC while the closure of the throttle valve occurs at 820 TDC. Even in these transient states the variation of the air-fuel ratio is suppressible.

As described before, the learning data is made up by drawing out the portion corresponding to the transient state. Thus, the DC characteristic in the steady state does not exhibit a high accuracy. Although the the broken line-indicated air-fuel ratio after the 800 TDC on the horizontal axis involves an offset, this is because the DC accuracy of the NN which is used in obtaining the in-cylinder air-fuel ratio on the simulation is low, and hence it should disappear in the case of the actual engine. Further, if enlarging the range of the learning, it may also disappear.

As described above, although this control method can not expect the improvement of the DC characteristic, the transient characteristic extremely improves.

Moreover, a description will be made hereinbelow of an air-fuel ratio control system with reference to the control block diagram of FIG. 23. In the illustration, an NN controller 231 comes under a basic fuel injection quantity based control system of the NN control systems stated in the above embodiments. This control system can raise the transient characteristic, while it is poor at the change with the passage of time and the variation among the objects. This is because the characteristic learned in advance in the NN controller 231 is used as the characteristic of an engine 232.

In the illustration, a PID controller 233 composes a large-scale FB loop and employs the same idea as the prior PI controller, wherein the exhaust gas air-fuel ratio is detected by an air-fuel ratio sensor to perform the FB. In this case, since the transient characteristic is improved by the NN controller 231, the PID controller 233 can serve to improve only the characteristic of the low-frequency component.

In the FIG. 12 air-fuel ratio control system, 30 TDC is used as the cut-off in the HPF. Accordingly, this FB can have a gain when the period component is above 30 TDC. In the engine under the test, the delay from the moment of the fuel injection to the moment the fuel burns and the air-fuel ratio sensor responds to the combustion was 10 and several TDCs, and hence the application of the FB to the frequency components whose period is above 30 TDC is certainly possible.

Figure 23:
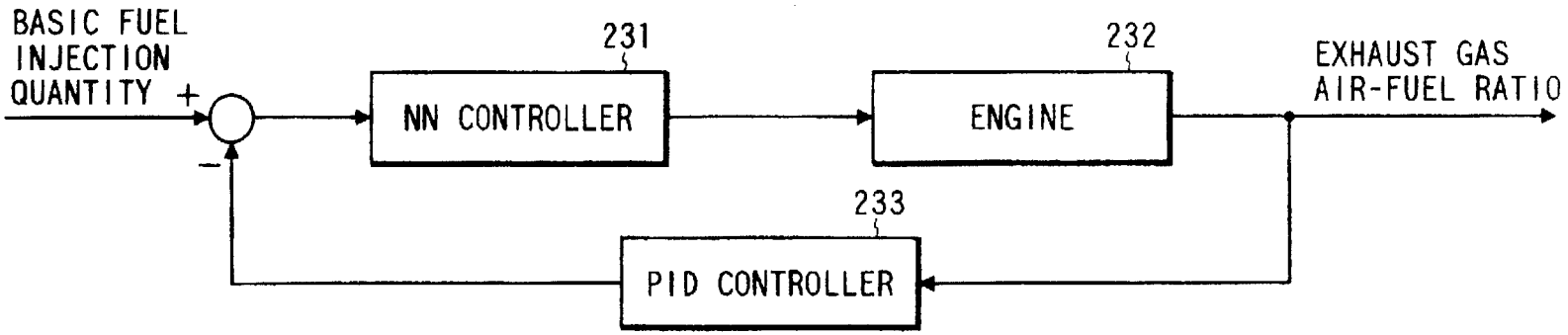
FIG. 23 is a control block diagram showing an air-fuel ratio control system according to a further embodiment of the present invention.
Figure 24:
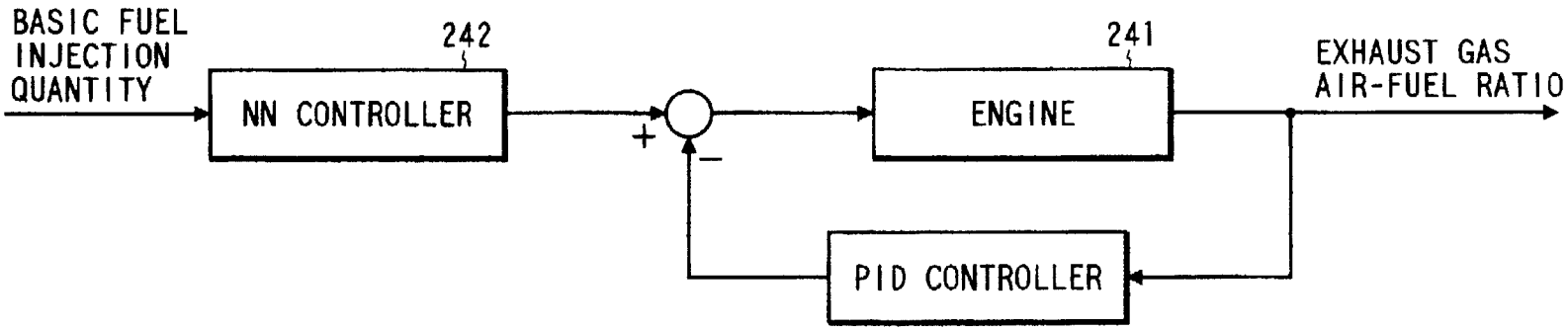
FIG. 24 is a block diagram showing a different control structure in the embodiments.
Figure 25:
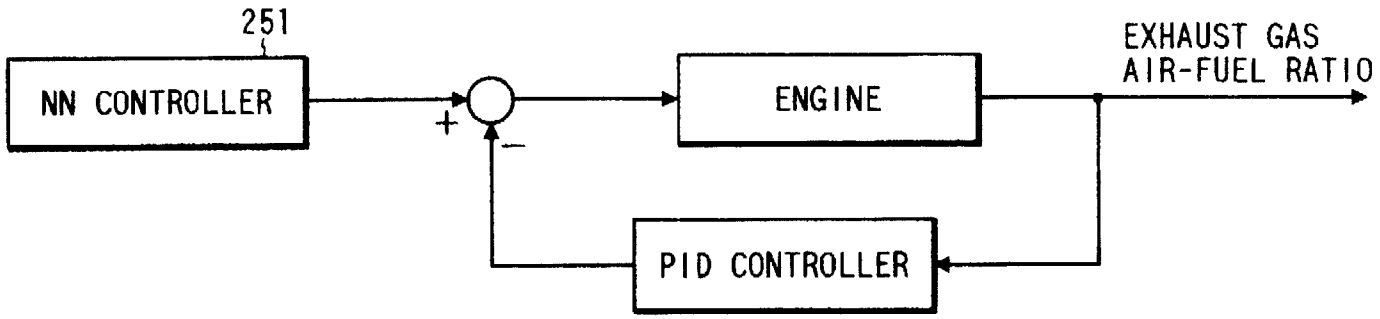
FIG. 25 is a block diagram showing a further different control structure in the embodiments.

FIG. 24 shows a further embodiment of this invention which applies the FB in relation to the final fuel injection quantity into an engine 241 as well as the FIG. 23 system. Further, FIG. 25 shows a further embodiment of this invention which does not use the the basic fuel injection quantity, although in FIG. 24 the basic fuel injection quantity is inputted in an NN controller 242. The FIG. 25 system including an NN controller 251 which does not receive the basic fuel injection quantity is equivalent to the FIG. 14 system.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention.

What is claimed is:

1. An air-fuel ratio control system for an internal combustion engine, comprising:

measuring means for attaining time series data including oxygen quantity estimating information for estimating a quantity of oxygen flowing into a cylinder of said engine, a fuel injection quantity into said cylinder and an air-fuel ratio of an exhaust gas from said engine, said exhaust gas air-fuel ratio being sensed through an air-fuel ratio sensor;

calculating means for applying the measured time series data to an engine model produced on the basis of a fuel attachment mechanism that makes fuel attached to an intake manifold of said engine and a time delay between the moment a fuel injection into said cylinder takes place and the moment said air-fuel ratio sensor responds to said exhaust gas for sensing said exhaust gas air-fuel ratio, to calculate an internal coefficient of said engine model and an air-fuel ratio within said cylinder;

neural network means for accepting said oxygen quantity estimating information and said fuel injection quantity and further accepting the calculated in-cylinder air-fuel ratio to learn the relationship among said oxygen quantity estimating information, said fuel injection quantity and the calculated in-cylinder air-fuel ratio, said neural network means being responsive to the oxygen quantity estimating information varying with time, a constant value expressing the current fuel injection quantity and the past fuel injection quantity to estimate an in-cylinder air-fuel ratio on the basis of these inputs, and outputting the estimated in-cylinder air-fuel ratio;

means for obtaining the difference between the estimated in-cylinder air-fuel ratio from said neural network and a target air-fuel ratio preset as a command value;

partial differential means for partially differentiating the estimated in-cylinder air-fuel ratio from said neural network means with respect to said fuel injection quantity;

ideal fuel injection quantity calculating means for calculating an ideal fuel injection quantity on the basis of a value obtained by dividing said difference between the estimated in-cylinder air-fuel ratio and said target air-fuel ratio by a partial differential value from said partial differential means, said ideal fuel injection quantity allowing the estimated in-cylinder air-fuel ratio to coincide with said target air-fuel ratio; and control means for controlling said fuel injection quantity actually supplied into said cylinder to said ideal fuel injection quantity.

2. An air-fuel ratio control system for an internal combustion engine, comprising:

measuring means for attaining time series data including oxygen quantity estimating information for estimating a quantity of oxygen flowing into a cylinder of said engine, a fuel injection quantity into said cylinder and an air-fuel ratio of an exhaust gas from said engine, said exhaust gas air-fuel ratio being sensed through an air-fuel ratio sensor;

calculating means for applying the measured time series data to an engine model produced on the basis of a fuel attachment mechanism that makes fuel attached to an intake manifold of said engine and a time delay between the moment a fuel injection into said cylinder takes place and the moment said air-fuel ratio sensor responds to said exhaust gas for sensing said exhaust gas air-fuel ratio, to calculate an internal coefficient of said engine model and an air-fuel ratio within said cylinder;

neural network means for accepting the current and past oxygen quantity estimating information and said fuel injection quantity and further accepting the calculated in-cylinder air-fuel ratio to learn the relationship among said oxygen quantity estimating information, said fuel injection quantity and the calculated in-cylinder air-fuel ratio, said neural network means further receiving the oxygen quantity estimating information varying with time, a constant value expressing the current fuel injection quantity and the past fuel injection quantity to estimate an in-cylinder air-fuel ratio on the basis of these inputs, and outputting the estimated in-cylinder air-fuel ratio;

means for obtaining the difference between the estimated in-cylinder air-fuel ratio from said neural network and a target air-fuel ratio preset as a command value;

partial differential means for partially differentiating the estimated in-cylinder air-fuel ratio from said neural network means with respect to said fuel injection quantity;

ideal fuel injection quantity calculating means for calculating an ideal fuel injection quantity on the basis of a value obtained by dividing said difference between the estimated in-cylinder air-fuel ratio and said target air-fuel ratio by a partial differential value from said partial differential means, said ideal fuel injection quantity allowing the estimated in-cylinder air-fuel ratio to coincide with said target air-fuel ratio; and control means for controlling said fuel injection quantity actually supplied into said cylinder to said ideal fuel injection quantity.

3. An air-fuel ratio control system as defined in claim 1, wherein said oxygen quantity estimating information is composed of necessary pieces of information selected from an air pressure within said intake manifold, an opening degree of a throttle value of said engine, an atmospheric pressure, a temperature of cooling water in said engine, an atmospheric temperature, a speed of said engine and an exhaust gas rotary flow rate in said engine.

4. An air-fuel ratio control system as defined in claim 2, wherein said oxygen quantity estimating information is composed of necessary pieces of information selected from an air pressure within said intake manifold, an opening degree of a throttle value of said engine, an atmospheric pressure, a temperature of cooling water in said engine, an atmospheric temperature, a speed of said engine and an exhaust gas rotary flow rate in said engine.

5. An air-fuel ratio control system for an internal combustion engine, comprising:

measuring means for attaining time series data including oxygen quantity estimating information for estimating a quantity of oxygen flowing into a cylinder of said engine, a fuel injection quantity into said cylinder and an air-fuel ratio of an exhaust gas from said engine, said exhaust gas air-fuel ratio being sensed through an air-fuel ratio sensor, said oxygen quantity estimating information being composed of necessary pieces of information selected from an air pressure within said intake manifold, an opening degree of a throttle value of said engine, an atmospheric pressure, a temperature of cooling water in said engine, an atmospheric temperature, a speed of said engine and an exhaust gas rotary flow rate in said engine;

calculating means for applying the measured time series data to an engine model produced on the basis of a fuel attachment mechanism that makes fuel attached to said intake manifold of said engine and a time delay between the moment a fuel injection into said cylinder takes place and the moment said air-fuel ratio sensor responds to said exhaust gas for sensing said exhaust gas air-fuel ratio, to calculate an internal coefficient of said engine model and an air-fuel ratio within said cylinder;

neural network means for accepting said oxygen quantity estimating information and said fuel injection quantity and further accepting the calculated in-cylinder air-fuel ratio to learn the relationship among said oxygen quantity estimating information, said fuel injection quantity and the calculated in-cylinder air-fuel ratio, said neural network means being responsive to the oxygen quantity estimating information varying with time, the latest fuel injection quantity being used as the current fuel injection quantity, and the past fuel injection quantity to estimate an in-cylinder air-fuel ratio on the basis of these inputs, and outputting the estimated in-cylinder air-fuel ratio;

means for obtaining the difference between the estimated in-cylinder air-fuel ratio from said neural network and a target air-fuel ratio preset as a command value;

partial differential means for partially differentiating the estimated in-cylinder air-fuel ratio from said neural network means with respect to said fuel injection quantity;

ideal fuel injection quantity calculating means for calculating an ideal fuel injection quantity on the basis of a value obtained by dividing said difference between the estimated in-cylinder air-fuel ratio and said target air-fuel ratio by a partial differential value from said partial differential means, said ideal fuel injection quantity allowing the estimated in-cylinder air-fuel ratio to coincide with said target air-fuel ratio; and control means for controlling said fuel injection quantity actually supplied into said cylinder to said ideal fuel injection quantity.

6. An air-fuel ratio control system for an internal combustion engine, comprising:

measuring means for attaining time series data including oxygen quantity estimating information for estimating a quantity of oxygen flowing into a cylinder of said engine, a fuel injection quantity into said cylinder and an air-fuel ratio of an exhaust gas from said engine, said exhaust gas air-fuel ratio being sensed through an air-fuel ratio sensor, said oxygen quantity estimating information being composed of necessary pieces of information selected from an air pressure within said intake manifold, an opening degree of a throttle value of said engine, an atmospheric pressure, a temperature of cooling water in said engine, an atmospheric temperature, a speed of said engine and an exhaust gas rotary flow rate in said engine;

calculating means for applying the measured time series data to an engine model produced on the basis of a fuel attachment mechanism that makes fuel attached to said intake manifold of said engine and a time delay between the moment a fuel injection into said cylinder takes place and the moment said air-fuel ratio sensor responds to said exhaust gas for sensing said exhaust gas air-fuel ratio, to calculate an internal coefficient of said engine model and an air-fuel ratio within said cylinder;

neural network means for accepting the current and past oxygen quantity estimating information and said fuel injection quantity and further accepting the calculated in-cylinder air-fuel ratio to learn the relationship among said oxygen quantity estimating information, said fuel injection quantity and the calculated in-cylinder air-fuel ratio, said neural network means being responsive to the oxygen quantity estimating information varying with time, the latest fuel injection quantity being used as the current fuel injection quantity, and the past fuel injection quantity to estimate an in-cylinder air-fuel ratio on the basis of these inputs, and outputting the estimated in-cylinder air-fuel ratio;

means for obtaining the difference between the estimated in-cylinder air-fuel ratio from said neural network and a target air-fuel ratio preset as a command value;

partial differential means for partially differentiating the estimated in-cylinder air-fuel ratio from said neural network means with respect to said fuel injection quantity;

ideal fuel injection quantity calculating means for calculating an ideal fuel injection quantity on the basis of a value obtained by dividing said difference between the estimated in-cylinder air-fuel ratio and said target air-fuel ratio by a partial differential value from said partial differential means, said ideal fuel injection quantity allowing the estimated in-cylinder air-fuel ratio to coincide with said target air-fuel ratio; and control means for controlling said fuel injection quantity actually supplied into said cylinder to said ideal fuel injection quantity.

7. An air-fuel ratio control system for an internal combustion engine, comprising:

measuring means for attaining time series data including oxygen quantity estimating information for estimating a quantity of oxygen flowing into a cylinder of said engine, a fuel injection quantity into said cylinder and an air-fuel ratio of an exhaust gas from said engine, said exhaust gas air-fuel ratio being sensed through an air-fuel ratio sensor, said oxygen quantity estimating information being composed of necessary pieces of information selected from an air pressure within said intake manifold, an opening degree of a throttle value of said engine, an atmospheric pressure, a temperature of cooling water in said engine, an atmospheric temperature, a speed of said engine and an exhaust gas rotary flow rate in said engine;

calculating means for applying the measured time series data to an engine model produced on the basis of a fuel attachment mechanism that makes fuel attached to said intake manifold of said engine and a time delay between the moment a fuel injection into said cylinder takes place and the moment said air-fuel ratio sensor responds to said exhaust gas for sensing said exhaust gas air-fuel ratio, to calculate an internal coefficient of said engine model and an air-fuel ratio within said cylinder;

neural network means for accepting said oxygen quantity estimating information and said fuel injection quantity and further accepting the calculated in-cylinder air-fuel ratio to learn the relationship among said oxygen quantity estimating information, said fuel injection quantity and the calculated in-cylinder air-fuel ratio, said neural network means being responsive to the oxygen quantity estimating information varying with time, a basic fuel injection quantity obtained through one of a table and an empirical formula made in advance on the basis of said oxygen quantity estimating information and used as the current fuel injection quantity, and the past fuel injection quantity to estimate an in-cylinder air-fuel ratio on the basis of these inputs, and outputting the estimated in-cylinder air-fuel ratio;

means for obtaining the difference between the estimated in-cylinder air-fuel ratio from said neural network and a target air-fuel ratio preset as a command value;

partial differential means for partially differentiating the estimated in-cylinder air-fuel ratio from said neural network means with respect to said fuel injection quantity;

ideal fuel injection quantity calculating means for calculating an ideal fuel injection quantity on the basis of a value obtained by dividing said difference between the estimated in-cylinder air-fuel ratio and said target air-fuel ratio by a partial differential value from said partial differential means, said ideal fuel injection quantity allowing the estimated in-cylinder air-fuel ratio to coincide with said target air-fuel ratio; and control means for controlling said fuel injection quantity actually supplied into said cylinder to said ideal fuel injection quantity.

8. An air-fuel ratio control system for an internal combustion engine, comprising:

measuring means for attaining time series data including oxygen quantity estimating information for estimating a quantity of oxygen flowing into a cylinder of said engine, a fuel injection quantity into said cylinder and an air-fuel ratio of an exhaust gas from said engine, said exhaust gas air-fuel ratio being sensed through an air-fuel ratio sensor, said oxygen quantity estimating information being composed of necessary pieces of information selected from an air pressure within said intake manifold, an opening degree of a throttle value of said engine, an atmospheric pressure, a temperature of cooling water in said engine, an atmospheric temperature, a speed of said engine and an exhaust gas rotary flow rate in said engine;

calculating means for applying the measured time series data to an engine model produced on the basis of a fuel attachment mechanism that makes fuel attached to said intake manifold of said engine and a time delay between the moment a fuel injection into said cylinder takes place and the moment said air-fuel ratio sensor responds to said exhaust gas for sensing said exhaust gas air-fuel ratio, to calculate an internal coefficient of said engine model and an air-fuel ratio within said cylinder;

neural network means for accepting the current and past oxygen quantity estimating information and said fuel injection quantity and further accepting the calculated in-cylinder air-fuel ratio to learn the relationship among said oxygen quantity estimating information, said fuel injection quantity and the calculated in-cylinder air-fuel ratio, said neural network means being responsive to the oxygen quantity estimating information varying with time, a basic fuel injection quantity obtained through one of a table and an empirical formula made in advance on the basis of said oxygen quantity estimating information and used as the current fuel injection quantity, and the past fuel injection quantity to estimate an in-cylinder air-fuel ratio on the basis of these inputs, and outputting the estimated in-cylinder air-fuel ratio;

means for obtaining the difference between the estimated in-cylinder air-fuel ratio from said neural network and a target air-fuel ratio preset as a command value;

partial differential means for partially differentiating the estimated in-cylinder air-fuel ratio from said neural network means with respect to said fuel injection quantity;

ideal fuel injection quantity calculating means for calculating an ideal fuel injection quantity on the basis of a value obtained by dividing said difference between the estimated in-cylinder air-fuel ratio and said target air-fuel ratio by a partial differential value from said partial differential means, said ideal fuel injection quantity allowing the estimated in-cylinder air-fuel ratio to coincide with said target air-fuel ratio; and control means for controlling said fuel injection quantity actually supplied into said cylinder to said ideal fuel injection quantity.

9. An air-fuel ratio control system for an internal combustion engine, comprising:

measuring means for attaining time series data including oxygen quantity estimating information for estimating a quantity of oxygen flowing into a cylinder of said engine, a fuel injection quantity into said cylinder and an air-fuel ratio of an exhaust gas from said engine, said exhaust gas air-fuel ratio being sensed through an air-fuel ratio sensor;

calculating means for applying the measured time series data to an engine model produced on the basis of a fuel attachment mechanism that makes fuel attached to an intake manifold of said engine and a time delay between the moment a fuel injection into said cylinder takes place and the moment said air-fuel ratio sensor responds to said exhaust gas for sensing said exhaust gas air-fuel ratio, to calculate an internal coefficient of said engine model and an air-fuel ratio within said cylinder;

ideal fuel injection quantity calculating means for calculating an ideal fuel injection quantity through a reverse operation on the basis of the calculated internal coefficient of said engine model, the calculated ideal fuel injection quantity allowing an air-fuel ratio within said cylinder to equal a target air-fuel ratio preset as a command value;

neural network means for accepting said oxygen quantity estimating information and the past fuel injection quantity and further accepting said ideal fuel injection quantity calculated through the reverse operation to learn the relationship among said oxygen quantity estimating information, the past fuel injection quantity and the calculated ideal fuel injection quantity, said neural network means being responsive to the oxygen quantity estimating information varying with time and the past fuel injection quantity to output an ideal fuel injection quantity obtained on the basis of these inputs; and control means for controlling said fuel injection quantity actually supplied into said cylinder to said ideal fuel injection quantity from said neural network means.

10. An air-fuel ratio control system for an internal combustion engine, comprising:

measuring means for attaining time series data including oxygen quantity estimating information for estimating a quantity of oxygen flowing into a cylinder of said engine, a fuel injection quantity into said cylinder and an air-fuel ratio of an exhaust gas from said engine, said exhaust gas air-fuel ratio being sensed through an air-fuel ratio sensor and said oxygen quantity estimating information being composed of necessary pieces of information selected from an air pressure within said intake manifold, an opening degree of a throttle value of said engine, an atmospheric pressure, a temperature of cooling water in said engine, an atmospheric temperature, a speed of said engine and an exhaust gas rotary flow rate in said engine;

calculating means for applying the measured time series data to an engine model produced on the basis of a fuel attachment mechanism that makes fuel attached to said intake manifold of said engine and a time delay between the moment a fuel injection into said cylinder takes place and the moment said air-fuel ratio sensor responds to said exhaust gas for sensing said exhaust gas air-fuel ratio, to calculate an internal coefficient of said engine model and an air-fuel ratio within said cylinder;

neural network means for accepting said oxygen quantity estimating information and said fuel injection quantity and further accepting the calculated in-cylinder air-fuel ratio to learn the relationship among said oxygen quantity estimating information, said fuel injection quantity and the calculated in-cylinder air-fuel ratio, said neural network means being responsive to the oxygen quantity estimating information varying with time and said fuel injection quantity to estimate an in-cylinder air-fuel ratio on the basis of these inputs, and outputting the estimated in-cylinder air-fuel ratio;

differential means for performing the differentiation of the estimated in-cylinder air-fuel ratio from said neural network to obtain a differential value and further for obtaining a partial differential value with respect to said fuel injection quantity;

correction amount calculating means for dividing the differential value by the partial differential value to calculate a fuel injection correction amount whereby said in-cylinder air-fuel ratio coincides with the previous in-cylinder air-fuel ratio; and addition means for adding the calculated fuel injection correction amount to a basic fuel injection quantity to obtain said fuel injection quantity to be actually supplied into said cylinder, said basic fuel injection quantity being obtained through one of a table and an empirical formula preset on the basis of said oxygen quantity estimating information, and said basic fuel injection quantity being used as the current fuel injection quantity.

11. An air-fuel ratio control system as defined in claim 10, wherein the actual fuel injection quantity into said cylinder is obtained in such a manner that, after passing through a limiting element for limiting an amplitude of an incoming signal, said fuel injection correction amount is added to basic fuel injection quantity.

12. An air-fuel ratio control system as defined in claim 10, wherein the actual fuel injection quantity into said cylinder is obtained in such a manner that a high-frequency component of said fuel injection correction amount is extracted through a high-frequency pass filter and is added to said basic fuel injection quantity.

13. An air-fuel ratio control system as defined in claim 5, further comprising means for detecting an internal state of said engine and a controller for feedbacking a signal based on the detected internal state to said fuel injection quantity.

14. An air-fuel ratio control system as defined in claim 6, further comprising means for detecting an internal state of said engine and a controller for feedbacking a signal based on the detected internal state to said fuel injection quantity.

15. An air-fuel ratio control system as defined in claim 9, further comprising means for detecting an internal state of said engine and a controller for feedbacking a signal based on the detected internal state to said fuel injection quantity.

16. An air-fuel ratio control system as defined in claim 11, further comprises means for detecting an internal state of said engine and a controller for feedbacking a signal based on the detected internal state to said fuel injection quantity.

17. An air-fuel ratio control system as defined in claim 12, further comprises means for detecting an internal state of said engine and a controller for feedbacking a signal based on the detected internal state to said fuel injection quantity.

* * * * *